US005987847A

United States Patent [19]

Nordstrom et al.

[11] Patent Number: 5,987,847

[45] Date of Patent: Nov. 23, 1999

[54] WRAPPING MACHINE AND METHOD

[75] Inventors: John E. Nordstrom, Manitowoc; Christopher J. Rusch, Two Rivers, both of Wis.

[73] Assignee: Omega Manufacturing Corporation, Two Rivers, Wis.

[21] Appl. No.: 08/950,538

[22] Filed: Oct. 15, 1997

Related U.S. Application Data

[63] Continuation-in-part of application No. 08/671,971, Jun. 28, 1996, abandoned, which is a continuation-in-part of application No. 08/605,262, Jan. 12, 1996, abandoned, which is a continuation-in-part of application No. 08/496,646, Jun. 28, 1995, abandoned.

[51] Int. Cl.[6] ..... B65B 11/28

[52] U.S. Cl. ..... 53/234; 53/204; 53/372.9

[58] Field of Search ..... 53/204, 409, 234, 53/372.8, 372.9, 210

[56] References Cited

U.S. PATENT DOCUMENTS

| | | | |
|---|---|---|---|
| 2,110,815 | 3/1938 | Parsons | 53/372.8 X |
| 2,301,016 | 11/1942 | Cannard | 53/204 |
| 2,363,751 | 11/1944 | Schultz et al. | 53/204 |
| 2,383,664 | 8/1945 | Malhiot | 53/204 X |
| 3,899,865 | 8/1975 | Revaz | 53/234 |
| 4,548,019 | 10/1985 | Kruse | 53/234 X |

*Primary Examiner*—Linda Johnson
*Attorney, Agent, or Firm*—Ryan Kromholz & Manion, S.C.

[57] ABSTRACT

A machine and method for wrapping cylindrical workpieces such as rolls of bathroom tissue and paper towel. The machine includes a workpiece infeed conveyor, a wrapping paper feeder, a rotating carousel having a plurality of pockets, and a discharge conveyor. A piece of wrapping paper supplied by the paper feeder is perforated and burst into a single sheet. The sheet and a workpiece are directed into a pocket in the rotating carousel whereby the sheet is banded around the periphery of the workpiece by a clamping plate, underfolder plate, and brush. Next a pair of stuffer spindles driven by a barrel cam and a pair of rotating star wheels whose compound motion is derived from geneva wheels fold and tuck the wrapping paper around the parallel sides and into the center tube of each workpiece. The wrapped workpieces are ejected from the rotating carousel onto a discharge conveyor. Alternative folder mechanisms include folding fingers. The method of wrapping is also disclosed.

28 Claims, 19 Drawing Sheets

WRAPPING MACHINE AND METHOD

This is a Continuation-in-Part of patent application Ser. No. 08/671,971 filed on Jun. 28, 1996, now abandoned, which was a Continuation-in-Part of patent application Ser. No. 08/605,262 filed on Jan. 12, 1996, now abandoned, which was a Continuation-in-Part of U.S. Parent patent application Ser. No. 08/496,646 filed on Jun. 28, 1995, now abandoned.

FIELD OF INVENTION

The present invention relates to the field of packaging machines for packaging workpieces. Specifically, the present invention relates to the packaging of workpieces made from paper, like bathroom tissue and paper towels.

BACKGROUND OF THE INVENTION

In the past packaging or wrapping machines for cylindrical workpieces, such as rolls of bathroom tissue and paper towels, have suffered many drawbacks. For example, some packaging machines have not been able to package the bathroom tissues rolls or paper towel rolls as fast as these products are manufactured. This is especially true when only a small number of rolls are packaged together or when each roll is wrapped separately.

A holding area or accumulator is typically established between the paper winder that forms the rolls and the wrapping machine to hold the overflow of rolls or workpieces waiting to be wrapped. The accumulator is used for two primary reasons. First, if the wrapping machine malfunctions or must be shut down for repair, the winder can continue to wind paper rolls from the parent or material roll and does not have to be shut down. The wound rolls are stored in the accumulator until the wrapping machine is running again. Second, when it is necessary to install a new parent roll in the winder, the winder is typically run faster before it is shut down. This quickly fills the accumulator with wound rolls and the wrapping machine can continue to operate and wrap the paper rolls stored in the accumulator while the parent roll is changed. A parent roll change takes approximately 20 minutes. The goal is to change the parent roll, restart the winder and begin producing wound paper rolls again before the wrapper has wrapped all of the rolls in the accumulator. If the goal is achieved, the wrapping machine does not have to be shut down each time the parent roll is changed.

Additionally, many prior art wrapping machines utilize glue. For example, prior art single roll wrapping machines often require that glue be applied on either the wrapping paper or on the wound roll so that the leading edge of the wrapping paper can be adhered to the wound roll. The wound roll is then rotated to draw the wrapping paper around the outer periphery of the roll. Besides adding extra expense to the machine and the wrapped product, glue is typically messy and can easily clog in the wrapping machine.

Prior art wrapping machines also suffer from a not insubstantial amount of down time and a fairly high scrap rate. Scrap rate is commonly defined as the amount of product which is not suitably wrapped and therefore cannot be sold. Scrap must be either rewrapped or disposed of. While some prior art machines are capable of wrapping at substantially the same rate as our wrapping machine, they are less reliable. An unreliable machine can produce many scrap pieces before the wrapping machine can be stopped and the problem fixed. If the wrapping machine is down for a period of time greater than the time it takes for the winder to fill the accumulator, the winder must be shut down as well.

Additionally, even if the prior art machines are functioning normally and/or operating at a rate of production equal to our wrapping machine they will still have a scrap rate that is higher than the scrap rate of our invention.

In the industry, the reliability of a wrapping machine is typically judged by the number of rolls wrapped per day, excluding scrap. Our invention comprises a wrapping machine for wrapping rolls of bathroom tissue or paper towels that can wrap the product at a much faster rate when compared with prior art machines having the same reliability. Our machine is highly reliable and has a very low scrap rate. Unlike known high rate machines, our wrapping machines does not require any glue to perform the wrapping process.

A major difference between our wrapping machine and some prior art wrapping machines is that in our machine the wound paper roll is not rotated. Our wrapper utilizes a rotating carousel having a plurality of pockets. The wrapping paper and wound roll or workpiece are sequentially fed into each pocket as the carousel rotates and the wrapping process occurs as the carousel makes one complete revolution. A fully wrapped workpiece is ejected near the end of the revolution and another piece of wrapping paper and workpiece are inserted. The workpieces are not rotated, relative to the carousel, when wrapped; only the carousel is rotated.

It is an object of our invention to provide a wrapping machine that wraps cylindrical workpieces reliably at a high rate of speed with little or no scrap produced. It is an object of our invention to provide such a wrapping machine that utilizes clamping and underfolding devices to snugly wind and hold the wrapping paper against the workpiece while it is wrapped. It is a further object to provide such a wrapping machine that utilizes a pair of geneva wheel driven star wheels along the outer edges of each pocket and a pair of stuffer spindles to neatly and securely fold the wrapping paper over the outer parallel sides of the workpiece and tuck the wrapping paper into the workpiece center tube. It is another object of our invention to apply the wrapper around the workpiece in a neat and secure fashion such that the wrapper fits snugly about the workpiece and there are no gaps between the wrapper and the workpiece. It is yet another object of our invention to provide a wrapping machine that is compact, can be easily moved, and is flexible with respect to the location of its infeed and exit conveyors.

These and other objects of our invention will become apparent in the descriptions that follow. We know of no prior art that teaches or discloses our invention.

SUMMARY OF THE INVENTION

Our invention comprises a wrapping machine for wrapping rolls of bathroom tissue, paper towels, and the like or equivalent. These products will be referred to herein as workpieces. Each workpiece has a cylindrical shape, an arcuate or curved outer surface, a pair of substantially circular substantially parallel outer sides or flat sides, and a center tube.

Our invention's primary components include a roll infeed conveyor, a wrapping paper feeder, a frame structure, a main motor and transmission, a rotating carousel mechanism having a plurality of wrapping stations or pockets, and a discharge assembly. The wrapping paper feeder includes a wrapping paper roll support, an unwinder, a dancer assembly having a festoon of rollers, a rotary cutter, a stationary cutter, and a pair of pinch rollers driven by another transmission. The rotating carousel rotates within the frame and is driven by the motor and transmission. Each wrapping pocket has associated with it a pair of stuffer spindles, a pair of star wheels, and movable pocket clamp and underfold devices.

The wound rolls of paper product or workpieces to be wrapped are fed into our wrapping machine by a roll infeed conveyor. The wound rolls or workpieces enter our wrapping machine such that their center tubes are in an axial direction with respect to the rotating carousel of the wrapping machine. The infeed conveyor can be placed on either side of the wrapping machine carousel.

Roll infeed conveyors are well known in the art. Any infeed conveyor capable of delivering the workpiece to our wrapping machine in the proper orientation could be used. The preferred roll infeed conveyor is the one taught and disclosed in U.S. Pat. No. 4,360,098 entitled INFEED CONVEYOR issued on Nov. 23, 1982. The roll infeed conveyor taught and disclosed in U.S. Pat. No. 5,050,724 entitled ROLL INFEED CONVEYOR issued on Sep. 24, 1991 could be used as well. The specifications of the U.S. Pat. Nos. 4,360,098 and 5,050,724 patents are incorporated herein by reference.

The wrapping paper utilized by our wrapping machine typically comes in a large roll. An axle or shaft is placed through the center core of the wrapping paper roll and the roll is rotatably supported on the axle by a pair of roll lifter arms along one side of our wrapping machine. An unwinding device including a unwind belt rests on the top of the wrapping paper roll and applies a predetermined force to the wrapping paper roll in order to accelerate, decelerate and uniformly feed wrapping paper to our wrapping machine. The function of the unwinding device is to meet the wrapping paper demand of the wrapping machine and eliminate the possibility of the wrapping paper being torn as it is drawn into the wrapping machine.

The wrapping paper is unwound from the paper roll by the unwinder and is drawn into the wrapping machine by a pair of pinch rollers. The pinch rollers are driven by a transmission which can be engaged and disengaged. Upon entering the machine, the wrapping paper is threaded through the festoon of rollers of the dancer assembly. A set of upper rollers are mounted to the machine frame and a set of lower rollers are mounted on a pair of pivotable dancer arms. The purpose of the dancer arms is to prevent tearing of the wrapping paper when the wrapping machine is first started. The dancer arms are also used as a control device for the unwinder belt.

In the idle mode, the carousel of our invention rotates at a predetermined rate. A sensing device, typically an electric eye, is attached to the infeed conveyor to determine the presence of workpieces to be wrapped. If a workpiece is not sensed, wrapping paper is not fed into the machine. When the first workpiece to be wrapped is sensed by the device and enters the wrapping machine, there is an immediate acceleration of the wrapping paper from rest to a wrapping paper speed predetermined by the amount of wrapping paper required to band and wrap one workpiece in one machine cycle. For reasons that will become evident, the predetermined wrapping paper speed is always less than the predetermined speed of the carousel.

When the sensing device determines the presence of a workpiece, the pinch roller transmission engages and draws the wrapping paper into the machine. If the wrapping paper, which is relatively thin, was drawn by the pinch rollers directly from the large paper roll, the wrapping paper would likely tear during the initial acceleration. To prevent tearing, before engaging the pinch rollers, the wrapping paper is threaded up and down over a plurality of paper rollers which form the dancer assembly. The upper rollers are fixed to the machine frame. The lower rollers are mounted to a pair of pivoting dancer arms or bars.

Even with the aid of the unwinder belt, the roll of wrapping paper cannot be sufficiently accelerated to meet the paper demand rate of the machine. When the first workpiece enters the machine and the paper roll is at rest, the greater rate of wrapping paper acceleration required by the machine is compensated for by the web of paper threaded through the festoon of rollers. As the paper is accelerated into the machine, the pivoting bars to which the lower rollers are attached move upward toward the upper rollers to compensate for the accelerating paper demand.

Through electro-mechanical means, the pivoting bars are connected to the paper roll unwinder. As the pivoting bars raise, the unwinder belt engages and unwinds wrapping paper from the roll. As the unwinder accelerates and continues to unwind, the pivoting bars now fall from their raised position to an equilibrium position where the wrapping paper is fed into the machine at a rate less than the rate at which the machine is operating.

Because the rolls of wrapping paper are heavy, the roll lifter arms that support the axle can be raised and lowered. Any type of lifting mechanism, such as pneumatic, hydraulic or ball screw lifters, can be utilized. When a new roll of wrapping paper is to be loaded, the axle is inserted through the roll center, the roll is positioned between the two lifter arms, and the pair of arms raise the roll so that the roll can freely rotate on the axle.

When the lifter arms are lowered to install a new roll, the unwinding mechanism simultaneously raises off of the old roll high enough so as to not interfere with the new roll to be installed. As the newly installed roll is raised, the unwinding mechanism simultaneously lowers into contact with the top of the new paper roll.

As previously stated, the wrapping paper is drawn into our wrapping machine between a pair of pinch rollers which can be engaged and disengaged by a transmission. Next, a rotary blade scores or perforates the wrapping paper at a predetermined position. The rotary blade works in conjunction with a knife. The knife has one or more nicks so that the rotary blade does not cut the entire width of the wrapping paper. The knife can be moved up into an engaged cutting position or down into a non-cutting position.

The rotary blade cuts the wrapping paper to a predetermined length. The length is determined by adding the workpiece circumference and the required wrapping paper lap. The lap is typically one inch.

The paper is then fed downward by the pinch rollers toward the rotating carousel mechanism at a speed rate slower than that of the rotating carousel. Below the carousel are located twin timing belts which each contain small raised portions or tabs. The speed of the timing belts matches the speed of the outside diameter of the carousel. On the outside diameter of the carousel are located vacuum blocks, one adjacent to each pocket. As the carousel vacuum block and one of the tabs on each belt come together, the wrapping paper is captured between the vacuum block and the respective tab of each belt. The speed differential between the pinch rollers and the faster speed of the timing belts and the vacuum blocks on the outside diameter of the carousel causes the wrapping paper to burst or tear at the perforation.

This action transfers individual sheets of wrapping paper onto the carousel in the correct location for each pocket opening. Each vacuum block is located above each carousel pocket. After the perforation is torn and the separated sheet is transferred to the carousel, a vacuum is applied to the vacuum block, and the tabs on the timing belts drop away. The wrapping paper is now attached to the carousel at the vacuum block by vacuum only. The leading portion of the wrapping paper sheet is held by the vacuum, the middle portion of the wrapping paper sheet is positioned so that it covers the pocket opening, and the trailing portion of the wrapping paper sheet extends beyond the pocket opening.

As the workpieces to be wrapped enter the wrapping machine from the infeed conveyor, they are pushed by the conveyor onto a curved ramp having twin ramp surfaces. The ramp extends upward and toward a portion of the carousel, the curvature or arc of the ramp being eccentric to the perimeter of the carousel. As the ramp surfaces extend upward, their bottom surfaces get closer to the outer diameter of the carousel.

At this point one flight, of a plurality of flights attached to a chain conveyor, contacts the workpiece tangentially at the ramp base and guides it up the ramp into a wrapping station or pocket in the carousel. The flights and pockets are timed such that as each flight rises from the bottom of the machine between the twin ramp surfaces, it remains aligned with a pocket on the carousel. As the carousel rotates at its rate of rotation, the flight pushes the workpiece up the ramp at the same rate of speed and into the pocket.

As the workpiece is pushed up the ramp by one of the flights, an extended ejector bar comes into contact with the workpiece having the wrapping paper trapped in between. As the workpiece is slowly pushed into the pocket by the flight and ramp, the ejector bar retracts into the pocket but constantly holds a slight pressure on the workpiece and wrapping paper. The ejector bar path substantially matches the ramp path. Furthermore, the ejector bar ejection length can be adjusted for any workpiece diameter. Without the ejector bar maintaining a slight pressure on the workpiece and wrapping paper, it is possible for the workpiece to rotate or turn as it is pushed into the pocket by the flight and ramp. There is also a possibility that the wrapping paper will move unrestricted within the pocket. The pressure maintained by the ejector rod on the wrapping paper and the workpiece prevents the workpiece from rotating and the wrapping paper from wandering within the pocket. The result, which is explained in detail below, insures that the ends of the wrapping paper are the same length and accordingly a proper lap is consistently formed at the same location.

Because the middle portion of the wrapping paper sheet covers the pocket opening, as the ramp and flight guide the workpiece into the pocket, the wrapping paper covers a portion of the workpiece as it also enters the pocket. Once in the pocket, approximately 240 degrees of the arcuate surface of the workpiece is covered by the wrapping paper sheet. Only the wrapping paper sheet leading portion and trailing portion extend out of the pocket opening.

To insure that the workpiece fully enters the carousel pocket, an optional poking mechanism is employed to push the workpiece completely into the pocket if necessary. The poking mechanism is driven by the same power source that powers the chain conveyor to which the flights are attached. The mechanism comprises an eccentric, a first bar member, a pivoting member, a second bar member, a roller, and a third bar member. The center of the eccentric is attached to the power source. The first bar member is connected to the edge of the eccentric at one end and to the pivoting member at the other end. The second bar member is connected to the pivoting member at one end and to the axis of the roller on the opposite end. The third bar memeber is also attached to the axis of the roller on one end and the the wrapping machine frame on the other end. The pivoting member has a third connecting point whereby the pivoting member is pivotally connected to the wrapping machine frame.

The poking mechanism is timed with the carousel such that after each workpiece has been ramped into a pocket, the roller attached to the end of the second bar member enters the pocket a predetermined distance and makes contact with the workpiece thereby pushing the workpiece completely into the pocket. The second bar member also includes a compression mechanism so that the workpiece is not damaged or crushed within the pocket. The compression mechanism has a predetermined compression force rate so that when the workpiece is fully positioned within the pocket, the second bar member compresses or shortens in length thus preventing damage to the workpiece.

The poking mechanism roller withdraws completely from the carousel pocket to a location outside of the diamater of the carousel before the pocket opening suffiently rotates to a postion where the inserted roller would strike the carousel. As each carousel pocket passes the location of the poking mechanism, the roller contacts the workpiece, pushes the workpiece completely into the pocket if necessary, and retracts before the carousel pocket moves past the poking mechanims location.

As the workpiece is ramped into contact with the wrapping paper sheet and into the pocket or wrapping station, two folder rod structures, stationary with respect to the carousel pocket with which they are associated, which are aligned with the axis of the workpiece, and which are located about 1¼ inches (3.18 centimeters) beyond the parallel ends of the workpiece roll after full workpiece insertion, contact the excess wrapping paper beyond the workpiece ends and begin to fold the wrapping paper toward the center or core of the workpiece.

As the carousel continues to rotate and after the workpiece has fully entered the pocket, a clamping mechanism, including a clamping plate and driven by an underfolder plate linkage, clamps the workpiece and wrapping paper sheet firmly into the pocket. After further carousel rotation an underfolder mechanism, including an underfolder plate connected to an underfolder arm, passes upward and across the opening in the pocket where the wrapping paper and workpiece are now clamped. As the underfolder plate moves up and across the opening, the trailing wrapping paper portion is directed upward and completely over the workpiece. The underfolder plate and clamp hold the trailing wrapping paper portion snugly against the workpiece so that there are no air pockets or gaps between the wrapping paper and the workpiece.

The remaining exposed wrapping paper end next encounters a brush mounted to the wrapping machine frame such that its bristles contact the outer diameter surface of the rotating carousel. When the carousel pocket arrives at the location of the brush, the remaining exposed wrapping paper end or leading portion is brushed over the trailing portion of the wrapping paper by the brush bristles to form the lap. The wrapping paper sheet is now fully banded in a cylindrical fashion or tube around the outer circumference of the workpiece. The side edges of the wrapping paper sheet now extend outward a predetermined distance beyond the flat circular parallel sides of the workpiece.

A stuffer mechanism includes a pair of stuffer spindles for tucking the wrapping paper sheet side edges into the center core are supported by a stuffer actuating block on each side of each pocket. The stuffer spindles are driven by a barrel cam mechanism which controls when the stuffer spindles are inserted into the workpiece centers and when the stuffer spindles are retracted from the workpiece centers. The camed stuffer spindle mechanism is driven by the rotation of the carousel. The barrel cam is attached to the machine frame and is located adjacent the carousel. The diameter of the barrel cam is approximately the same as the diameter of the carousel. Cam followers, which are connected by linkages to the stuffer spindles, ride in the barrel cam.

Now that the wrapping paper has fully surrounded the outer circumference of the work piece and one portion of each side edge is folded toward the workpiece center by the pair of stationary rods, the pair of stuffer spindles first enter the center tube of the workpiece and tuck a first portion of the wrapping paper sheet.

The stuffer spindle mechanisms include a pressure limiting feature which prevents the stuffer spindles from pushing the extended portions of the wrapping paper into the center tube of the workpiece with such force that the friction between the stuffer spindles and the wrapping paper, within the confines of the workpiece tube, causes the paper to tear or become damaged.

A wide flat belt is supported by the frame over the top portion of our wrapping machine. The belt is supported by a plurality of pulleys. It is driven by a number of stationary plates that are attached to the carousel outer periphery. The stationary plates are similar in structure to the underfolder plates except that they do not move. When the pocket containing the workpiece first comes into contact with the belt, the underfolder plate partially retracts and the belt comes into contact with the exposed portion of the wrapping paper including the lap. The belt holds the wrapping paper firmly against the workpiece during the subsequent folding operations of the wrapping paper sheet around the workpiece sides.

A folder mechanism, including a star wheel, is also located on each side of each pocket. Each star wheel has a center axis that is mounted on an arm and is driven by a geneva wheel assembly. The star wheel makes two motions. First, the star wheel rotates on its own axis. Second, the star wheel axis moves in an arc on the arm around a portion of the periphery of the workpiece side. Both motions are accomplished by a geneva wheel assembly, linkage, gearing, and timing belt.

Next, the stuffer spindles withdraw and the star wheels on each side of the workpiece driven by the geneva wheel begin to spin on their centers and around a portion of the periphery of the ends of the workpiece. As each star wheel spins, it engages the outer edges of the wrapping paper and folds them against the sides and toward the center of the workpiece. When the star wheels complete their first motion, the stuffer spindles next re-enter the workpiece center thereby tucking the wrapping paper into the workpiece center tube. The stuffer spindles next retract. The star wheels begin to spin again and move around the remaining portion of the periphery of the workpiece. The star wheels stop and the stuffer spindles stuff a third and final time.

The stuffer spindles must be withdrawn before the star wheels can rotate. Each star wheel has a plurality of points or sides. When stopped, the stuffer spindles pass through one of the gaps between the star wheel points. If the stuffer spindles were not withdrawn, the star wheel points would strike the stuffer spindles when they begin to rotate.

In the above example, the stuffer spindles stuff and retract once, then the star wheels spin around 180 degrees of the periphery of the workpiece, the stuffer spindles stuff and retract a second time, the star wheels spin around the remaining 180 degrees of the workpiece periphery, and the stuffer spindles stuff and retract a third and final time. The sequence can be varied to include additional or fewer stuffer and/or star wheel cycles and still produce a fully wrapped workpiece.

An alternative folder mechanism is utilized to wrap workpieces where a more aesthetically pleasing wrap is desired. This is especially desirable when the wrapped workpieces are sold at the retail level directly to the consumer. The alternative folder mechanism is nearly identical to the folder mechanism described above except for the addition of another geneva wheel and a bearing surface and the removal of a portion of teeth on the gearing.

The stuffer spindels make their initial stroke into the workpiece center tube ends. After they are withdrawn, the star wheels on each side of the workpiece begin to spin on their axles and their arms move in an arcuate direction around a portion of the periphery of the workpiece. As each star wheel spins and as each arm moves along the arcute path, the star wheel ends engage the outer edges of the wrapping paper and fold them against the sides and the toward the center of the workpiece. The stuffer spindels next re-enter the workpiece center tube thereby tucking the ends of the folded wrapping paper into the workpiece center tube. After the stufer spindels retract, the star wheels begin to spin and move again.

While the star wheels still move in an arcuate motion around the remaining periphery of the workpiece edge, the star wheels only rotate on their axles during a predetermined portion of the remaining arcuate movement. The result is a more aesthetically pleasing wrapped workpiece.

Nonrotational motion of the star wheels while continuing the arcuate motion of the arms is acheived by removing a predetermied number of teeth from one of the gears and by adding another geneva wheel and bearing surface to the folder mechanism. The arms that support the star wheel axles and star wheels are carried through the nonrotational motion portion of the folder mechanism by the engagement of the geneva wheel with the bearing surface. At the end of the genvea wheel stroke, the gear teeth mesh again and rotational motion of the star wheel is resumed.

The rotating carousel pocket next rotates to an exit chute where a pair of upper and lower conveyor belts, having a fixed gap and moving linearly at the same rate as the rate of rotation of the carousel, grips each wrapped workpiece as it is ejected by an ejector bar within the pocket. The conveyor belts carry the wrapped workpiece to a discharge conveyor. Once on the discharge conveyor, the wrapped workpieces are transported to a location where they are collated, boxed, cartoned, cased, etc.

The ejector bar remains in its fully extended position until a new workpiece begins to be ramped into the pocket. As described above, the ejector bar retracts as the workpiece is ramped into the pocket by the flight and ramp and constantly maintains a slight pressure on the workpiece and the wrapping paper.

Also, an optional gluing mechanism can be incorporated into our wrapping machine. The gluing mechanism employs glue guns that apply glue to the wrapping paper prior to wrapping the workpieces. After application of the glue, the glue is allowed to dry on the wrapping paper prior to the wrapping of the workpiece. After the workpiece has been banded, a hot belt is utilized to remelt the glue and adhere portions of the wrapping paper to other portions of the wrapping paper. While glue is not required to practice our invention, glue may be desired. A workpiece with a glued wrapper has a marketing advantage in that it is perceived as being more sanitary.

A second alternative folder mechanism is utilized to wrap work pieces, providing an improved and more aesthetic wrap.

A pair of stuffer spindles are utilized in the alternative folder mechanism. The structure of each spindle includes a flat folding surface and a hollow center portion. The stuffer spindles are driven by a barrel cam which is mounted to the wrapping machine frame. A plurality of cam followers ride in the cam. A cam follower is connected to each stuffer spindle through a spindle rod. The stuffer spindles advance initially toward the work pieces's center tube ends and act as a mandrel during the initial fold performed by the folding fingers mechanism. The folding finger mechanism is discussed infra. The spindles are then withdrawn as the initial fold is completed. The stuffer spindle finally advance toward each work piece again, this time contacting the ends of the work piece and tucking the wrapping paper sheet ends into the work piece center core.

As with the previous embodiments, a folder mechanism is mounted on each side of the rotating carousel adjacent to each pocket. In this embodiment, the folder mechanisms comprise folding finger mechanisms. Each folder mechanism is mounted to a crimper plate. A first crimper frame is mounted to the wrapping machine frame parallel to the rotating carousel. The second crimper frame is mounted on the opposite side of the carousel. This alternative embodiment of the folder mechanism further comprises an activating arm, a lever plate, a plurality of folding fingers, and a connecting link.

Each crimper frame is attached to each side of the carousel at each pocket. The activating arm is pivotally coupled to the crimper frame and the lever plate by means of a pivot shaft. The connecting link has one end coupled to the activating arm, and the other end coupled to at least one folding finger.

An activating arm or crimper cam is mounted to the wrapping machine frame. A cam follower, engaged within the cam, is attached to an end of the activating arm. As each activating arm moves along a predetermined path, limited to an arcuate segment by the activating arm cam and a pivot shaft, it activates the folding fingers through the connecting link. The fingers are grouped in pairs, preferably three pairs on each side of the work piece. Each pair of folding fingers has a different configuration to provide accurate folding of the wrapping paper. While the preferred embodiment utilizes three pairs of fingers on each side of the wrapping station, it is to be understood that a lesser or greater number of fingers could be utilized while practicing our invention.

The folding fingers describe a circular path, engaging the outer edge or margins of the wrapping paper and concentrating the outer margin of the paper toward the center of the work piece, thus creating a paper column. As the activating arm reverses its trajectory, the folding fingers retract and the stuffer spindles re-enter the work piece's center tube, thereby folding the wrapping paper against the sides of the workpiece and tucking the column formed by the ends of the folded wrapping paper into the work piece's center tube. Due to the hollow center of the stuffer spindles, the wrapping paper is neatly tucked in and is prevented from unfolding.

It should be understood that each embodiment of the present invention disclosed herein may be described in a preferred embodiment depending upon the commercial concerns regarding the product produced by each embodiment. Therefore, depending upon the desired commercial application each embodiment disclosed herein may separately be considered a best mode of the invention depending upon the goals of the person using the apparatus and/or method disclosed herein.

DESCRIPTIONS OF THE DRAWINGS

DETAILED DESCRIPTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1A:
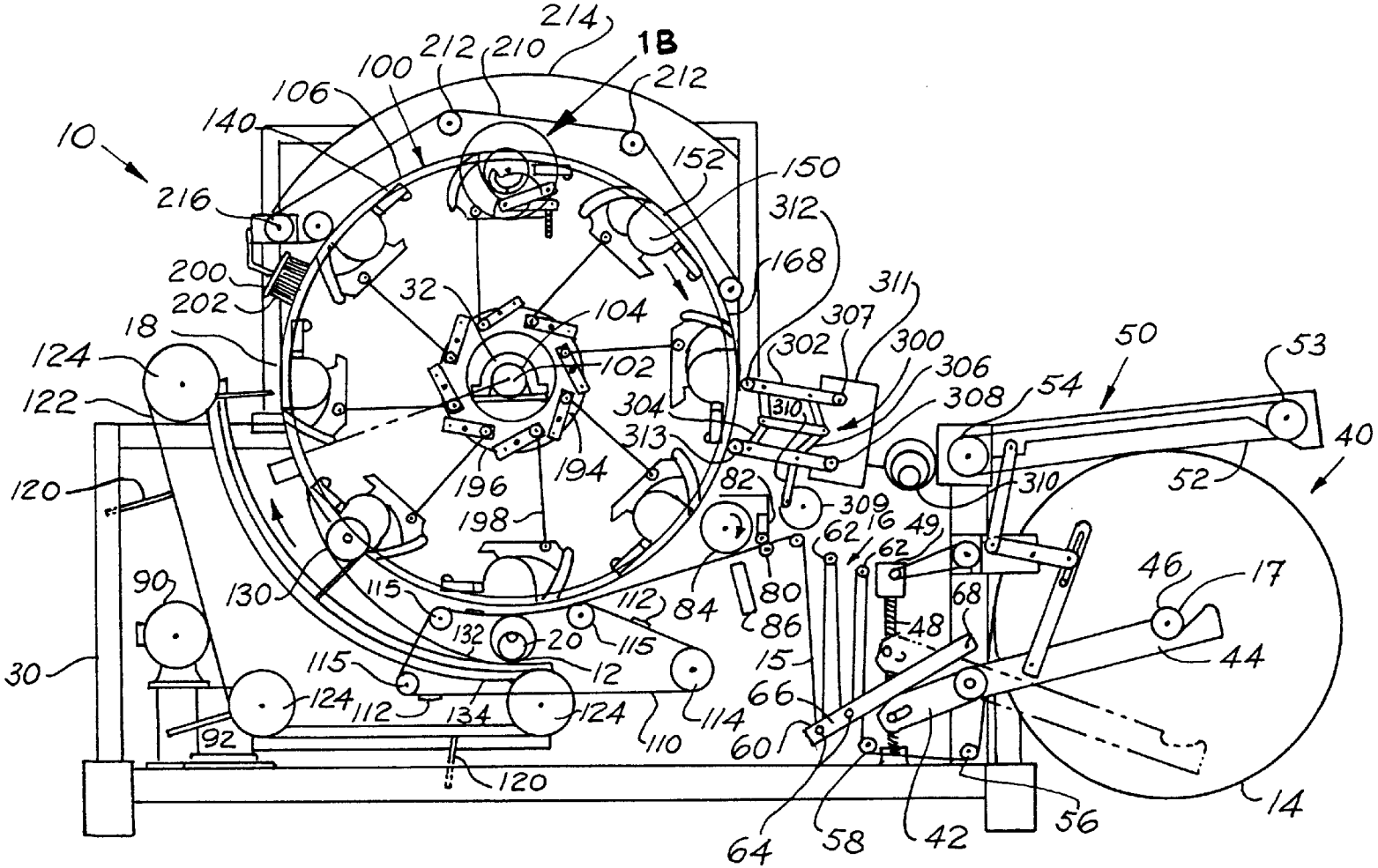
FIG. 1A is a front elevational view of our wrapping machine.

Our invention, shown generally in FIGS. 1A, 2A, and 3–5, comprises a wrapping machine 10 for applying a paper wrapper 18 to a roll of bathroom tissue, paper towel, or workpiece 12. Its primary components include an infeed conveyor 20 (FIG. 3), a frame structure 30 (FIG. 1A), a wrapping paper feeder 40 (FIG. 1A), a main motor 90 and transmission 92 (FIG. 1A), a rotating carousel mechanism 100 having a plurality of wrapping stations or pockets 150 (FIG. 1A), and a wrapped product discharge 300 (FIG. 1A).

An electric three (3) horsepower motor 90 is mounted within frame structure 30. The motor 90 is coupled to a worm and gear reducer or transmission 92. From transmission 92, power is distributed to various components of our wrapping machine 10 as further described.

The carousel mechanism 100 is rotatably supported within frame 30 by axle 102 and bearing blocks 32. Axle 102 is covered by a tube 104 which does not rotate. The carousel 100 rotates on its axle 102 and is driven by rotary power derived from transmission 92. In our preferred embodiment, the carousel 100 has eight (8) pockets 150. However, it is to be understood that the number of pockets 150 in carousel 100 could be changed without varying from our invention.

Figure 3:
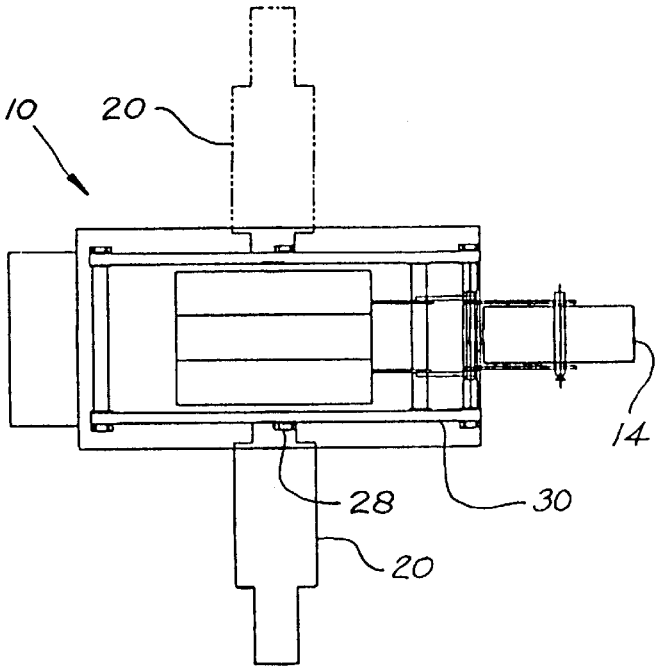
FIG. 3 is top plan view of our wrapping machine.

The wound rolls of paper product or workpieces 12 to be wrapped are fed into our wrapping machine 10 by a roll infeed conveyor 20. Referring to FIG. 3, the placement of the infeed conveyor 20 can be seen; however, it could be located on either side of the wrapping machine 10. Infeed conveyors 20 are well known in the art. The roll infeed conveyor used in our preferred embodiment is the one taught and disclosed in U.S. Pat. No. 4,360,098 entitled INFEED CONVEYOR issued on Nov. 23, 1982. The workpieces 12 enter our wrapping machine 10 such that their center tubes 13 are oriented in an axial direction with respect to the rotating carousel 100 of the wrapping machine 10. The infeed conveyor 20 has a plurality of flight bars or pusher rods. The pusher rods are identified at reference numerals 78, 79, and 80 in the U.S. Pat. No. 4,360,098 patent. Each flight bar or pusher rod pushes a workpiece 12 into our wrapping machine 10. When the workpiece 12 has been conveyed to the proper location, the flight bar or pusher rod drops below the surface upon which the workpiece 12 is conveyed.

As shown in FIG. 1A, the wrapping paper feeder 40 includes a wrapping paper roll support 42, an unwinder 50, a dancer 60 having a festoon of upper rollers 62 and lower rollers 64, a pair of pinch rollers 80 driven by a second transmission 82, a rotary cutter 84, and a movable blade 86.

Figure 4:
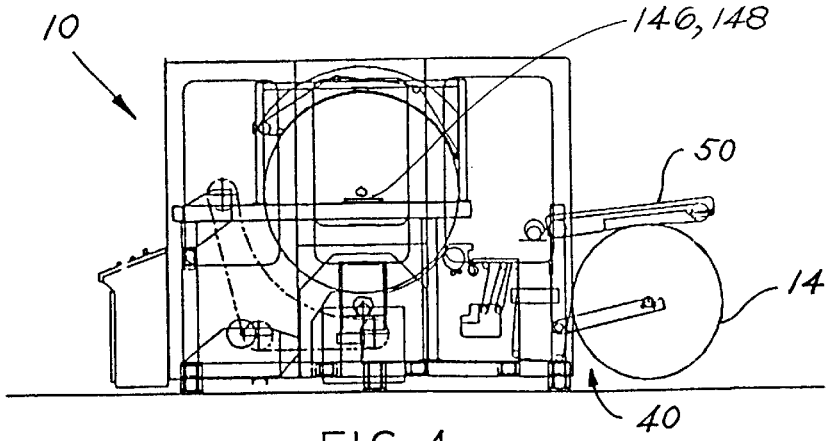
FIG. 4 is front elevational view of our wrapping machine showing the frame and control panel.
Figure 5:
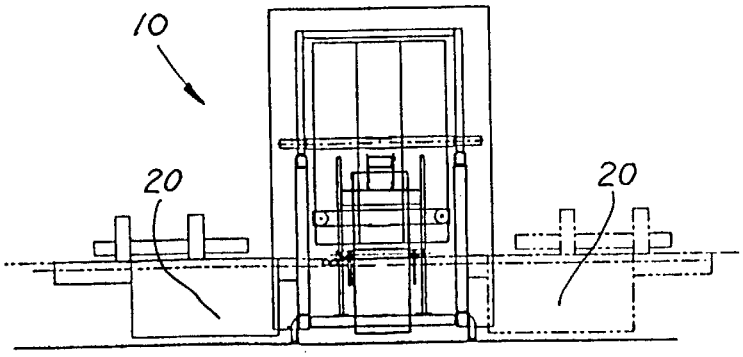
FIG. 5 is a right side elevational view of our wrapping machine.

The wrapping paper 15 utilized by our wrapping machine 10 typically comes in a large roll 14 as shown in FIGS. 1A, 3, and 4. The wrapping paper is typically a 17 pound paper, although other weights and types of paper could be used. An axle 46 is placed through the center core 17 of the wrapping paper roll 14 and the roll 14 is rotatably supported on the axle 46 by a pair of roll lifter arms 44 along one side of our wrapping machine 10.

Because the rolls 14 of wrapping paper 15 are heavy, the roll lifter arms 44 that support the axle 46 can be raised and lowered. As best shown in FIG. 1A, a ball screw lifter 48 coupled to a motor 49 is connected to the lifter arms 44. When a new roll 14 of wrapping paper 15 is to be loaded, the axle 46 is inserted through the roll center 17, the roll 14 is positioned between the two lifter arms 44, and the pair of arms 44 raise the roll 14 so that the roll 14 can freely rotate on the axle 46.

When the lifter arms 44 are lowered to install a new roll 14 an unwinding mechanism 50, discussed in detail below, simultaneously raises off of the old roll 14 high enough so as to not interfere with the new roll 14 to be installed. As the newly installed roll 14 is raised by ball screw lifter 48, the unwinding mechanism 50 simultaneously lowers into contact with the top of the new paper roll 14.

As best shown in FIG. 1A, the unwinding mechanism 50 having unwinder belt 52 rests on the top of the wrapping paper roll 14. The belt is supported by and rotates between a pair of sheaves or pulleys 53. One sheave 53 is driven by a motor 54 which is actuated by a potentiometer switching mechanism 68 discussed below. The belt 52 applies a predetermined force to the wrapping paper roll 14 in order to accelerate, decelerate, and uniformly feed wrapping paper 15 to our wrapping machine 10.

The wrapping paper 15 is unwound from the paper roll 14 by the unwinder 50 and is drawn into the wrapping machine by a pair of pinch rollers 80. Upon entering the machine 10, the wrapping paper 15 is first threaded beneath a first single roller 56 to a second single roller 58 and then through a festoon of upper rollers 62 and lower rollers 64. The set of upper rollers 62 are mounted to the frame 30 and the set of lower rollers 64 are mounted between a pair of pivotable arms 66. The rollers 62 and 64 form dancer 60. The wrapping paper 15 wound through the dancer 60 forms a web 16. The purpose of the dancer 60 and web 16 is to prevent tearing the wrapping paper 15 when the wrapping paper 15 is first fed into the wrapping machine 10.

The rotating shaft of a potentiometer 68 is connected to one of the pivoting arms 66. The potentiometer 68 controls the speed of unwinder motor 54. When wrapping paper 15 is initially drawn in the machine 10, web 16 is shortened and pivoting arms 66 rise. As pivoting arms 66 rise and rotate the shaft on potentiometer 68, potentiometer 68 actuates unwinder motor 54 so that wrapping paper 15 is unwound from roll 14 by unwinder belt 52.

The pair of pinch rollers 80 draw the wrapping paper 15 into the machine 10. The pinch rollers 80 are controlled by a transmission 82 which can be engaged and disengaged. Adjacent to the pinch rollers 80 is located a rotary knife 84. A movable blade 86 is positioned below the rotary knife. When actuated, the movable blade 86 rises approximately 0.030 inch (0.0762 centimeter) to perforate or score the wrapping paper 15 into wrapping paper sheets 18. The paper width is perforated and not completely cut by rotary knife 84 and movable blade 86. Blade 86 includes three notches and the paper 15 is not cut at each notch.

The rotary knife 84 and movable blade 86 perforate the wrapping paper 15 to a predetermined length. The length is determined by adding the workpiece 12 circumference and the required wrapping paper lap. The workpiece diameter varies from 3.5 inches (8.9 centimeters) to 5.5 inches (14.0 centimeters). The lap is typically one inch (2.54 centimeters). The workpiece 12 length or cut length also varies from 3.5 inches (8.9 centimeters) to 4.5 inches (11.4 centimeters).

In the idle mode, the carousel 100 of our invention 10 rotates at a rate of approximately 12.5 revolutions per minute. An electric eye 28 is attached near the end of the infeed conveyor 20 to determine the presence of workpieces 12 to be wrapped. If a workpiece 12 is not sensed, wrapping paper 15 is not fed into the machine 10. When the first workpiece 12 to be wrapped is sensed by the eye 28 and enters the wrapping machine 10, there is an immediate acceleration of the wrapping paper 15 by the pinch rollers 80 from rest to a speed predetermined by the amount of wrapping paper required to band and wrap one workpiece 12 in one machine cycle. The predetermined speed is calculated using the diameter of the workpiece to be wrapped and the desired lap. In all cases, the predetermined speed will be less than the carousel rate of rotation.

When the eye 28 determines the presence of a workpiece 12, the pinch roller transmission 82 engages and draws the wrapping paper 15 into the machine 10. If the wrapping paper 15, which is relatively thin, was drawn by the pinch rollers 80 directly from the large paper roll 14, the wrapping paper 15 would likely tear during the initial acceleration. To prevent tearing, before engaging the pinch rollers 80 the wrapping paper 15 is threaded up and down in a web 16 over the plurality of paper rollers 62 and 64 which form the dancer 60.

Even with the aid of the unwinder belt 52, the roll of wrapping paper 14 cannot be sufficiently accelerated to meet the paper demand rate of the machine 10. When the first workpiece 12 enters the machine 10 and the paper roll 14 is at rest, the rate of wrapping paper acceleration imparted by the pinch rollers 80 is compensated for by the web 16 of paper 15 threaded through the dancer 60. As the paper 15 is accelerated into the machine 10, the pivoting arms 66 to which the lower rollers 64 are attached pivot upward toward the upper rollers 62 to compensate for the accelerating paper demand. As the pivoting arms 66 rise, the potentiometer 68 actuates the unwinder belt 52 which unwinds wrapping paper 15 from the roll 14. As the unwinder 50 accelerates and continues to unwind, the pivoting arms 66 begin to fall from their raised position to an equilibrium position where the wrapping paper 15 is fed to the machine 10 at the same rate the machine 10 is operating.

The paper 15 is then fed downward by the pinch rollers 80 toward the rotating carousel 100 at a rate of speed slower than that of the rotating carousel. Below the carousel 100 are located twin timing belts 110 which each contain small raised portions or tabs 112. As shown in FIG. 1A, the timing belts 110 ride on timing belt sheaves 114 and 115. The speed of the timing belts 110 matches the speed of the outside diameter of the carousel 100. On the outside diameter of the carousel 100 are located vacuum blocks 140, one adjacent and above each pocket 150 in carousel 100. As the carousel vacuum block 140 and one of the tabs 112 on each belt 110 come together, the wrapping paper 15 is captured between the vacuum block 140 and the respective tab 112 of each belt 110. The speed differential between the pinch rollers 80 and the carousel 100 causes the wrapping paper 15 to burst or tear at the perforation into individual sheets 18.

This action transfers individual sheets of wrapping paper 18 onto the carousel 100 in the correct location for each pocket opening 152. After the perforation is torn and the separated sheet 18 is transferred, a vacuum is applied to the vacuum block 140 and the tabs 112 on the timing belts 110 drop away. A vacuum motor 142 is mounted to frame 30. The vacuum motor 142 is connected by a conduit 143 to a vacuum manifold 144 located around the axle 102 of rotating carousel 100. From the manifold 144, smaller conduits 145 run to each vacuum block 140. The manifold 144 includes a vacuum valve 146 mounted to frame 30 through suitable brackets and a vacuum drum 148 mounted to axle 102 for applying a vacuum to each vacuum block during the required portion of the carousel cycle.

The wrapping paper sheet 18 is now attached to the carousel 100 at the vacuum block 140 by vacuum only. The leading portion of the wrapping paper sheet 18 is held by the vacuum, the middle portion of the wrapping paper sheet 18 covers the pocket opening 152, and the trailing portion of the wrapping paper sheet 18 extends beyond the pocket opening 152.

As each workpiece 12 to be wrapped enters the wrapping machine 10 from the infeed conveyor 20, it is pushed by the conveyor 20 onto a curved ramp 130 that extends upward and around a portion of the carousel 100. The ramp 130 is best shown in FIG. 1A. As the ramp 130 extends upward, its bottom surface 132 gets closer to the outer diameter of the carousel 100.

Also referring to FIG. 1A, it can be seen that a plurality of flights 120 are attached to a chain conveyor 122. The chain conveyor 122 is driven on a series of sprockets, one of which derives its power from transmission 92. The center of the arc made by the chain conveyor 122 is the same as the center of the carousel 100 diameter. Thus, the flights 120 remain a fixed distance from carousel 100 as they travel around the arc. A flight 120 contacts the workpiece 12 tangentially at the ramp base 134 and guides the workpiece 12 up the ramp along its bottom surface 132 into a pocket 150 in the carousel 100. The flights 120 and pockets 150 are timed such that as each flight 120 rises from the bottom of the machine 10, it is aligned with a pocket 150 on the carousel 100. As the carousel 100 rotates at its rate of rotation, each flight 120 pushes a workpiece 12 up the ramp 130 at the same rate of speed and into a pocket 150. While the flights 120 remain at the fixed distance from the carousel 100, the ramp surface 132 gets closer to the carousel 100 as the ramp 130 extends about the carousel 100.

Because the middle portion of the wrapping paper sheet 18 covers the pocket opening 152, as the ramp 130 and flight 120 guide the workpiece 12 into the pocket 150 the wrapping paper sheet 18 also enters the pocket 150 and surrounds a portion of the workpiece 12. Once in the pocket 150, approximately 240 degrees of the workpiece 12 is covered by the wrapping paper sheet 18. Only the wrapping paper sheet 18 leading portion and trailing portion extend out of the pocket opening 152.

Figure 10:
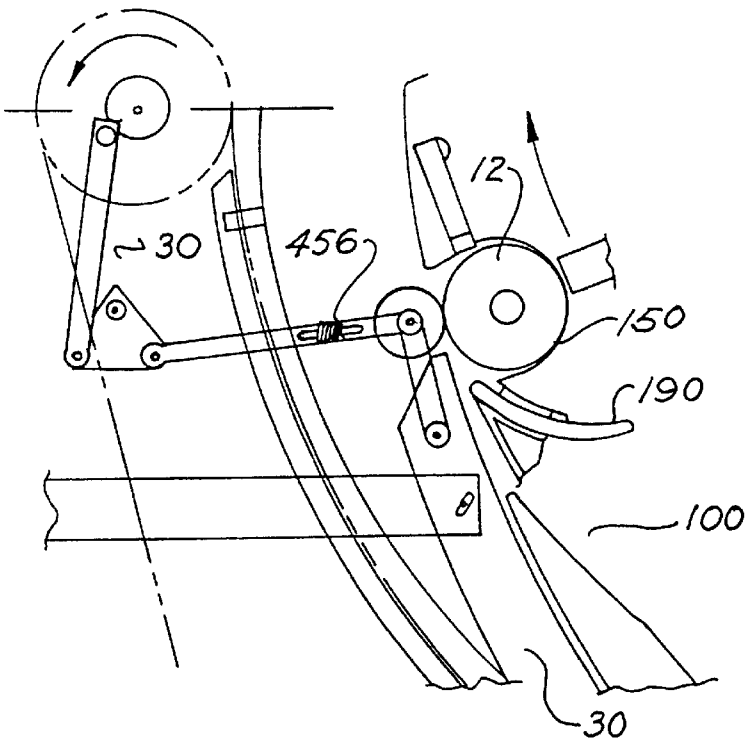
FIG. 10 is a detailed front elevational view of the carousel and the poker mechanism showing the poker mechanism in its extended position.
Figure 9:
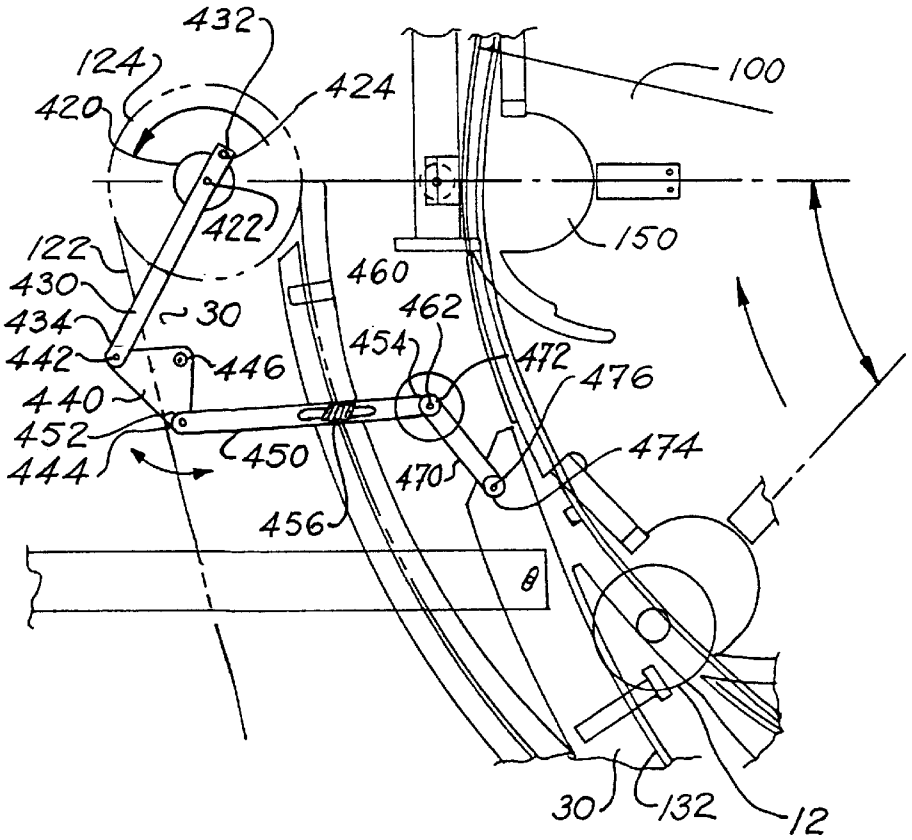
FIG. 9 is a detailed front elevational view of the carousel and the poker mechanism showing the poker mechanism in its retracted position.

To insure that each workpiece 12 fully enters each carousel pocket 150, an optional poking mechanism 410 is employed to push each workpiece 12 completely into the pocket 150 if necessary. The poking mechanims is shown in FIGS. 9 and 10. The poking mechanism 410 is driven by motor 90 and transmission 92 which also powers the chain conveyor 122 to which flights 120 are attached. The mechanism 410 comprises the following componts: an eccentric 420, a first bar member 430, a pivoting member 440, a second bar member 450, a roller 460, and a third bar member 470. The center 422 of the eccentric 420 is attached to the same axle that sheave 124 rotates on. End 432 of first bar member 430 is connected to the edge of the eccentric 420 at point 424. End 434 of first bar member 430 is attached to the pivoting member 440 at point 442. An end 452 of second bar member 450 is connected to the pivoting member 440 at point 444 while end 454 is connected to the axis 462 of the roller 460. The third bar memeber 470 is also attached to the axis 462 of the roller 460 on an end 472. The opposite end 474 is connected to the wrapping machine frame 30. Pivoting member 440 has a third connecting point 446 also pivotally connecting it to the wrapping machine frame 30.

The poking mechanism 410 is timed with the carousel 100 such that after each workpiece 12 has been ramped into a pocket 150, roller 460 enters the pocket 150 a predetermined distance and makes contact with the workpiece 12 thereby pushing the workpiece 12 completely into the pocket 150. To prevent damage to the workpiece 12, second bar member 450 also includes a compression mechanism 456. In the preferred embodiment, the second bar member 450 is broken into two pieces that are connected by spring. The spring has a predetermined compression spring rate so that when the workpiece 12 is fully positioned within the pocket 150, the second bar member 450 compresses or shortens in length thus preventing damage to the workpiece 12.

Roller 460 withdraws completely from the carousel pocket 150 to a location outside of the diamater of the carousel 100 before the pocket opening 152 suffiently rotates to a postion where the inserted roller 460 would strike the carousel 100. As each carousel pocket 150 passes the location of the poking mechanism 410, roller 460 contacts the workpiece 12, pushes the workpiece 12 completely into the pocket 150 if necessary, and retracts before the carousel pocket opening 152 moves past the poking mechanism location.

Figure 1B:
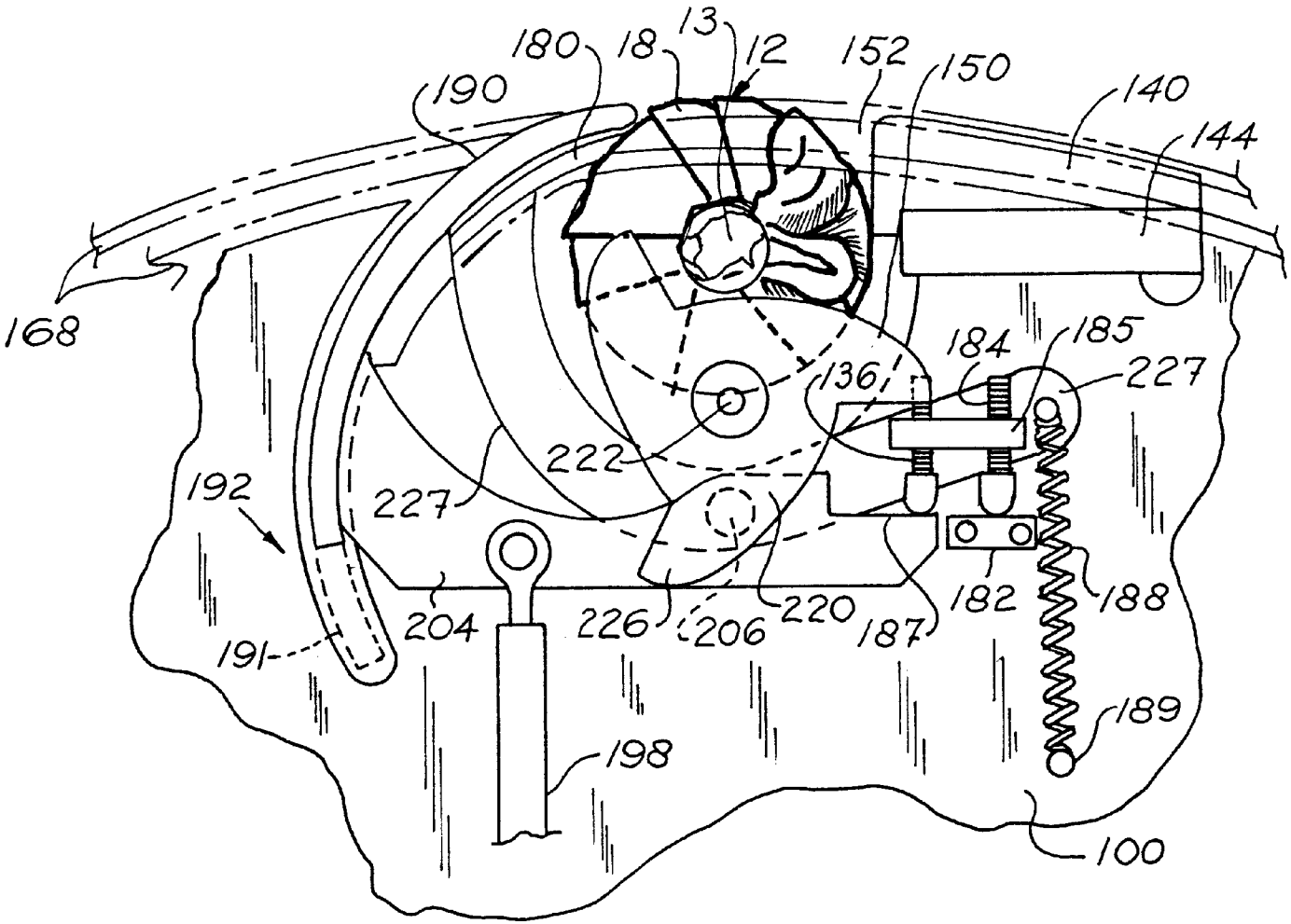
FIG. 1B is a detailed front elevational view of a pocket as shown in FIG. 1A.
Figures 2A, 2B:
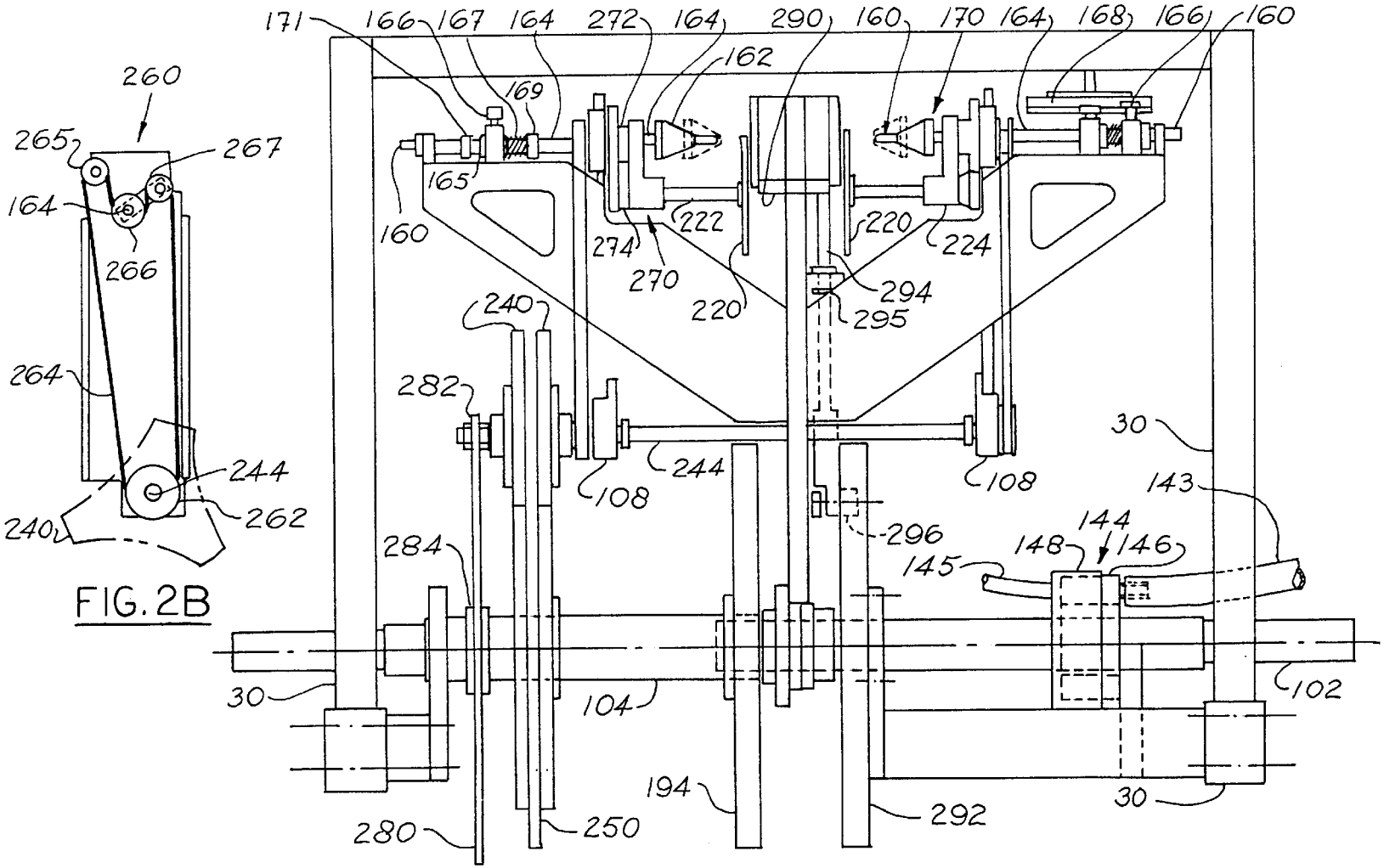
FIG. 2A is a right side elevational view of a stuffer and ejector mechanism.
FIG. 2B is a front elevational view of the star wheel belt.

Two stationary rods 160, as shown in FIG. 2A, are aligned with the axis of the workpiece 12 and are located about 1¼ inches (3.18 centimeters) beyond the parallel ends of the workpiece 12. As the workpiece 12 is ramped into contact with the wrapping paper sheet 18 and into the pocket 150, the rods 160 contact the excess wrapping paper 18 beyond the workpiece 12 ends and begin to fold the wrapping paper 18 toward the center or core 13 of the workpiece 12. The stationary rods 160 remain fixed in place after full workpiece 12 insertion into the pocket 150. As the carousel 100 continues to rotate and after the workpiece 12 has fully entered the pocket 150, a clamp plate 180 shown in FIG. 1B, driven by an underfolder plate linkage 192, clamps the workpiece 12 and wrapping paper sheet 18 firmly into the pocket 150. After further carousel rotation, an underfolder plate 190 passes upward and across the opening 152 in the pocket 150 where the wrapping paper sheet 18 and workpiece 12 are now located. As the underfolder plate 190 moves up and across the opening 152, the trailing wrapping paper portion is directed upward and completely over the workpiece 12.

The clamp plate 180 and underfolder plate 190 are driven by an underfolder plate linkage 192. The linkage 192 includes an underfolder cam 194, cam followers 196, connecting rods 198, underfolder arms 204, clamp arms 227 including internal ear 185, stop blocks 182, clamp plate screws 184, underfolder plate screws 186, pins 189, and springs 188.

The underfolder cam 194 is mounted to tube 104 adjacent rotating carousel 100. The cam 194 does not rotate. For each pocket 150, a cam follower 196 rides in cam 194. Each cam follower 196 is connected to a connecting rod 198 that extends to the corresponding underfold arm 204.

On the carousel 100 at each pocket 150, an underfolder arm 204 pivots at pivot point 206. The rotation of carousel 100 around non rotating cam 194 moves connecting rod 198 which in turn moves arm 204 and underfolder plate 190 through an arc around pivot 206 and across pocket opening 152. FIG. 1B shows the underfolder plate 190 partially through its arc. Dotted lines 191 show its position before beginning to move through its arc. The motion of underfolder arm 204 and plate 190 also controls the motion of clamp plate 180, which pivots about pivot point 206 by means of clamp arm 227. Clamp plate 180 has two functions and derives its motion by the same cam system which moves underfolder plate 190 through its prescribed arc. The functions accomplished by clamp plate 180 are to firmly clamp workpiece 12 and wrapping paper sheet 18 into pocket 150 and to snugly hold the trailing wrapping paper portion against workpiece 12 to insure a tight wrap of paper 18 around workpiece 12.

Underfolder plate 190 also moves through its arc around the same pivot 206 and derives its motion from underfolder arm 204. When underfolder plate 190 is located in its fully retracted position 191 about pivot 206 clamp plate 180 is also fully retracted from workpiece 12, since it also moves through its arc around the same pivot 206, and derives its motion from underfolder arm 204 by means of clamp arm 227, stop block 182, clamp plate screw 184, internal ear 185, underfolder plate screw 186 and surface 187.

In its fully retracted position 191, screw 186 bears against surface 187 of underfolder arm 204, screw 184 is retracted from stop block 182, and spring 188 is fully extended. One end of spring 188 is connected to carousel 100 by pin 189. The other end is connected to clamp arm 227. Stop block 182 is mounted to carousel 100. Ear 185 is part of arm 227. Since screw 186 is held against surface 187 through the tension of spring 188, as underfolder arm 204 begins moving through its arc, clamp arm 227 also begins to move. As underfolder arm 204 continues through its arc, clamp plate 180 contacts workpiece 12 and wrapping paper sheet 18 and snugly clamps them into pocket 150 by the force derived by the external spring 188. As arm 204 continues through its arc, clamp plate 180 and clamp arm 227 stop moving forward, either by plate 180 squeezing against workpiece 12 or by screw 184 bumping against stop block 182. When the clamp plate 180 has stopped moving, underfolder plate 190 continues moving through its full arc and finishes its function of folding trailing portion of wrapping paper 18 against workpiece 12.

The underfolder plate 190 and clamp plate 180 hold the trailing wrapping paper portion snugly against the workpiece 12 so that there are no air pockets or gaps between the wrapping paper sheet 18 and the workpiece 12.

A brush 200 is mounted to the wrapping machine frame 30 such that its bristles 202 contact the outer diameter surface of the rotating carousel 100. When each carousel pocket 150 arrives at the location of the brush 200, the remaining exposed wrapping paper end or leading portion is brushed over the trailing portion of the wrapping paper by the brush bristles 202 to form the lap. The wrapping paper sheet 18 is now fully banded in a cylindrical fashion around the outer circumference of the workpiece 12. The side edges of the wrapping paper sheet extend outward a predetermined distance beyond the flat circular parallel sides of the workpiece 12.

Figure 6A:
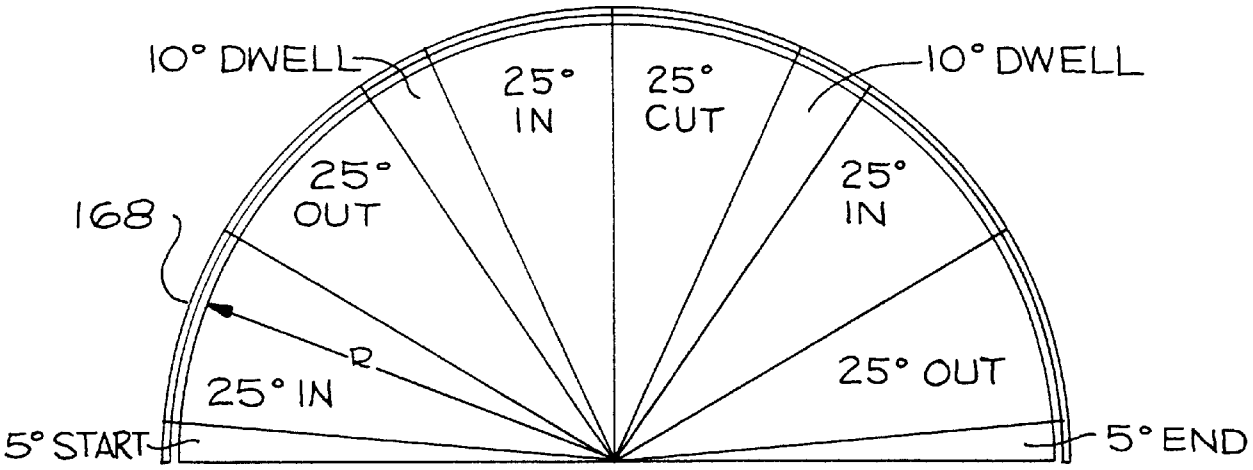
FIG. 6A is a front elevational view of the stuffer spindle barrel cam of our wrapping machine and shows the cam timing.
Figure 6B:
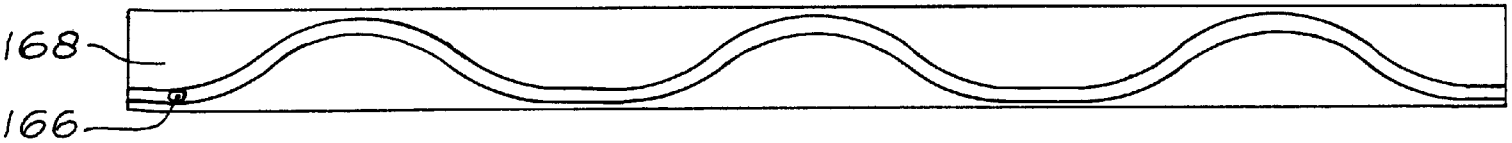
FIG. 6B is a view of the barrel cam of FIG. 6A laid flat.

As best shown in FIG. 2A, a pair of stuffer spindles 162 for tucking the wrapping paper sheet 18 side edges into the center core 17 are attached to connecting tubes 164 which ride on the stationary rods 160. The stuffer spindles 162 are actuated by stuffer actuating cams followers 166. Each cam follower 166 is driven by a barrel cam 168 which controls when the stuffer spindles 162 are inserted into the workpiece center tubes 13 and when the stuffer spindles 162 are retracted from the workpiece center tubes 13. The upper portion of the barrel cam 168 is shown in detail in FIGS. 6A and 6B. FIG. 6A shows the timing of the barrel cam 168 upper portion including its start portion, insert portions, dwell portions, withdraw portions, and end portion. The entire camed stuffer spindle mechanism 170 is driven by the rotation of the carousel 100. The barrel cam 168 is attached to the frame 30 and is located adjacent the carousel 100. The diameter of the barrel cam 168 is approximately the same as the diameter of the carousel 100.

Now that the wrapping paper is fully banded around the outer circumference of the workpiece 12 and one portion of each side edge is folded toward the workpiece center 13 by the pair of stationary rods 160, the pair of stuffer spindles 162 first enter the center tube 13 of the workpiece 12 and tuck a first portion of the wrapping paper sheet 18 into the center tube 13.

The force of the stuffer spindles which enter the center tube 13 of workpiece 12 is limited by a spring 167 which is mounted to each spindle tube 164. The cam follower 166 which rides in barrel cam 168 is mounted to a bearing block 165 which is free to slide on connecting tube 164. As shown in FIG. 2A, the spring 167 is mounted between bearing block 165 and collar 169 which is fixed to tube 164. On the other side of bearing block 165 is mounted another collar 171 which is also fixed to tube 164. When the barrel cam 168 and cam follower system 170 push the stuffer spindle 162 and a portion of wrapping paper sheet 18 into the center of the tube 13 of workpiece 12, resistance may be encountered as the stuffer spindle 162 pushes the gathered portion of paper into center tube 13. When this occurs, spring 167 compresses between bearing block 165 and collar 169, and limits stuffing pressure to that of the compression rate of the spring 167. Collar 171 is used only to maintain the proper lateral location of bearing block 165 to tube 164 when spring 167 is not compressed during the retracted position of stuffer spindle 162.

A wide flat belt 210 is supported on a series of sheaves 212 mounted to a subframe 214 which is positioned over the top portion of our wrapping machine 10. The subframe 214 is pivotally attached to the wrapping machine frame 30 at pivot point 216. The belt 210 is driven by a number of stationary plates 106 that are attached to the carousel 100 outer periphery. The stationary plates 106 are similar in structure to the underfolder plates 190 except that they do not move. When the pocket 150 containing the banded workpiece 12 first comes into contact with the belt 210, the underfolder plate 190 partially retracts but the clamp plate continues clamping the banded workpiece 12 into the pocket 150. The belt 210 comes into contact with the exposed portion of the wrapping paper sheet 18 including the lap. The belt 210 holds the wrapping paper 18 firmly against the workpiece 12 during the subsequent folding operations of the wrapping paper sheet 18 around the workpiece sides.

As best shown in FIG. 1B, a star wheel 220 is also located on each side of each pocket 150. As also shown in FIG. 2A, each star wheel 220 is mounted to a drive axle 222 that is rotatably supported within an arm 224. As shown, the axle 222 is supported on one end of the arm 224 and the other end of the arm 222 is supported by and pivots about spindle tube 164.

Figure 8:
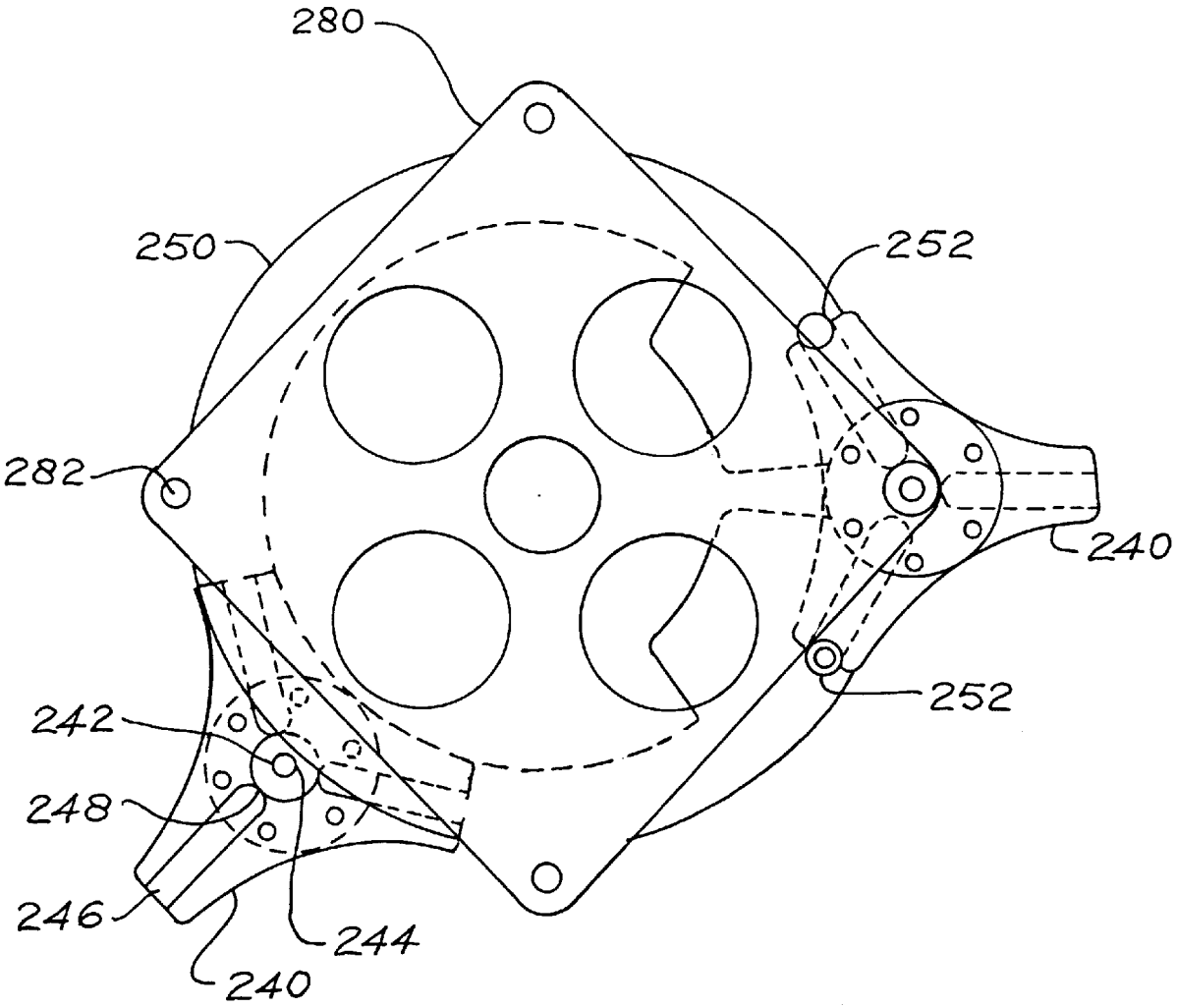
FIG. 8 is a front elevational view of the geneva assembly including a stiffener plate.

Now referring to FIGS. 2A, 2B, and 8, the star wheel 220 makes two motions. First, the star wheel 220 rotates on its drive axle 222. Second, the star wheel axle 222 moves in an arc on the arm 224 around a portion of the periphery of the workpiece side. Both motions are accomplished by a geneva wheel 240, a geneva plate 250, a drive system 260, and a gearing system 270.

The geneva plate 250 is mounted to the carousel tube 104 which does not rotate with the carousel 100. A plurality of geneva wheels 240, one for each pocket 150, are rotatably supported at their centers 242 on axles 244. One end of each axle 244 is connected to the carousel 100 at bearing 108 and the other is connected to stiffener plate 280 at stiffener plate bearing 282. The stiffener plate 280 is supported by bearing 284 over tube 104 and rotates with the carousel 100.

A plurality of cam rollers 252 are mounted to the geneva plate 250 which does not rotate. As the geneva wheel 240 rotates with the carousel 100, the cam rollers 252 enter the slots 246 in each geneva wheel 240. As each cam roller 252 enters a slot 246, reaches the base 248 of the slot 246, and retracts from the slot 246, the geneva wheel 240 rotates one third of a revolution.

Now referring to FIG. 2B, the geneva wheel axle 244 is coupled to driven sheave 262 of drive system 260. A belt 264 is threaded around a group of sheaves including sheave 265, 266, and 267. Sheave 266 is connected to stuffer spindle tube 164. Gear 272 is fixed on the same center as tube 164. Gear 274, fixed to star wheel axle 222, is mounted on arm 224 by suitable bearings. Thus when geneva wheel 240 rotates, the rotational motion is transferred directly to the star wheel axle 222 to produce the spinning motion of star wheel 220 and to the gearing system 270 mounted to arm 224. When rotating arm 224 is driven by the geneva wheel 240, rotating gear 274 moves around fixed gear 272 which is on the same center as stuffer spindle tube 164.

Sheave 262 contains one and one half as many teeth as sheave 266. Therefore, one third revolution of geneva wheel 240 turns tube 164 one half revolution. For each one third revolution of geneva wheel 240, arm 224 moves around one half of the periphery of the sides of the workpiece 12 and each star wheel 220 makes one and one half revolutions. One half revolution of the star wheel 220 is derived by the one half revolution of arm 224 around tube 164 and an additional one revolution of motion is produced because gear 272 has twice as many teeth as gear 274.

Referring back to FIG. 2B, the purpose of sheaves 265 and 267 is to allow for adjustment of the position of stationary rods 160 for different diameter workpieces 12 without having to change the length of the belt 264. Sheaves 266 and 267 remain at a constant fixed distance from each other. The portion of the belt 264 from sheave 265 to sheave 266 and the portion from sheave 267 to driven sheave 262 are always parallel. When the position of sheave 266, which rotates about stationary rod 160, is changed, the slack or excess belt portion between sheaves 265 and sheave 266 is compensated for by the excess or slack belt portion between sheave 267 and driven sheave 262.

After the stuffer spindles 162 withdraw from their initial insertion, the star wheels 220 on each side of the workpiece 12 driven by the geneva wheel 240 begin to spin on their center axles 222 and begin to move on arms 224 around a portion, one half revolution, of the periphery of the ends of the workpiece 12. As each star wheel 220 spins, its star points 226 engage the outer edges of the wrapping paper sheet 18 and folds them against the workpiece sides toward the center of the workpiece 12.

When the star wheels 220 complete their first motion, the stuffer spindles 162 re-enter the workpiece center tube 13 thereby tucking the wrapping paper sheet 18 into the workpiece center tube 13. The stuffer spindles 162 next retract a second time. The star wheels 220 begin to spin again and move around the remaining one half revolution portion of the periphery of the workpiece 12. The star wheels 220 stop and the stuffer spindles 162 stuff a third and final time.

The stuffer spindles 162 must be withdrawn before the star wheels 220 can rotate. Each star wheel 220 has a plurality of points or sides 226. When stopped, the stuffer spindles 162 pass through one of the gaps between the star wheel points 226. If the stuffer spindles 162 were not withdrawn, the star wheel points 226 would strike the stuffer spindles 162 when the star wheels 220 begin to rotate.

The above described wrapping sequence is the preferred sequence. It is to be understood that the sequence can be varied to include additional or fewer stuffer and/or star wheel cycles and still produce a fully wrapped workpiece 12.

An alternative folder mechanism 500 is utilized to wrap workpieces where a more aesthetically pleasing wrap is desired. The alternative folder mechanism 500 is nearly identical to the folder mechanism described above except for the addition of another geneva wheel 510 and a bearing surface 520 and the removal of a portion of teeth on gear 274. The alternative folder mechanism is shown in FIGS. 11 and 12.

Figure 11:
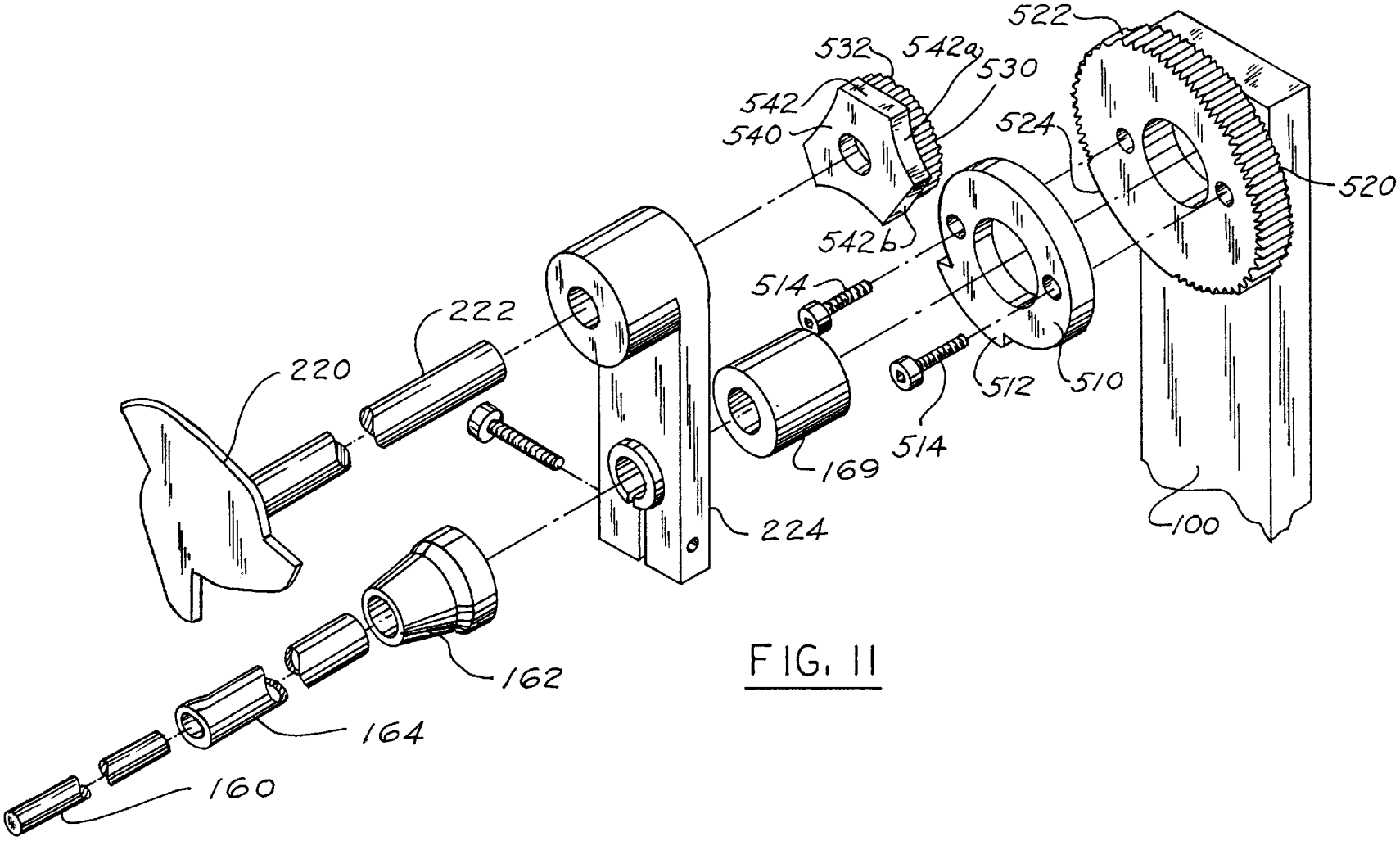
FIG. 11 is an exploded perspective view of the alternative portion of the folder mechanism.

Referring to FIG. 11, the stuffer mechanism 500 can be seen to comprise star wheel 220, star wheel axle 222, arm 224, stationary rod 160, stuffer spindel 162, tube 164, a bushing 169, a pawl 510, a stationary gear 520, a rotating gear 530, and a geneva wheel 540. The star wheel 220, star wheel axle 222, arm 224, stationary rod 160, stuffer spindel 162, tube 164, and the bushing 169 are identical to the components used in the embodiment previously described. Gear 520 is similar to gear 274 and gear 530 is similar to gear 272.

Figure 12:
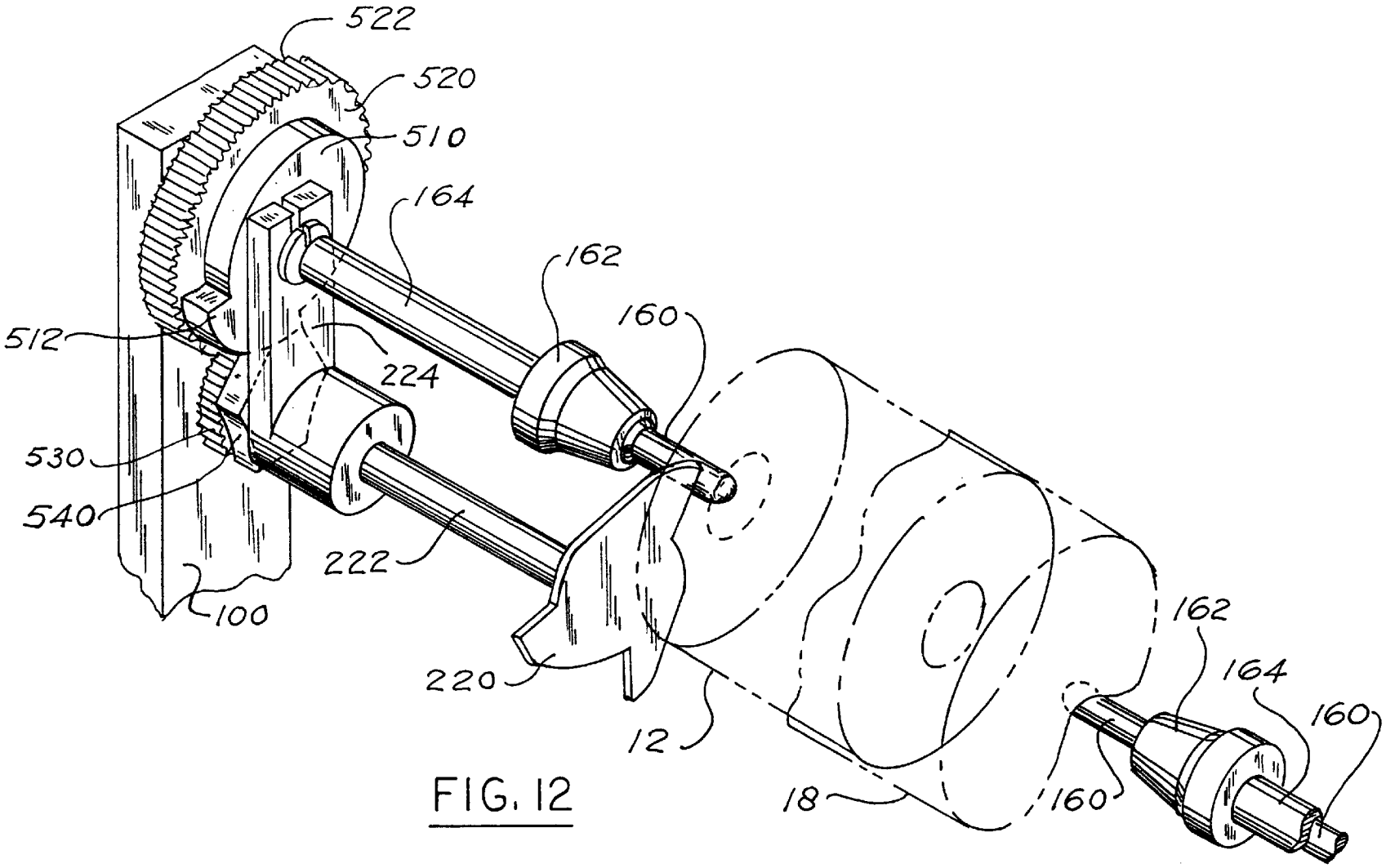
FIG. 12 is a perspective view of the alternative portion of the folder mechanism and a workpiece.

Pawl 510 includes a bearing surface 512 as shown in FIGS. 11 and 12. Fasteners 514 pass through openings in pawl 510 and similar openings in gear 520 to attach both structures to the carousel 100. Thus gear 520 does not rotate. Gear 520 has gear teeth 522 around 320 degrees of its outer periphery. Gear teeth are not located on the remaining 40 degree portion shown at 524.

Gear 530, which has half as many teeth 532 as gear 520, is coupled to geneva wheel 540. The end of star wheel axle 222 is connected to gear 530 and geneva wheel 540 through their central axes.

The assembled alternative folder mechanims is shown in FIG. 12. A workpiece 12 and a portion of the wrapping paper 18 is also shown. As the workpiece 12 and wrapping paper 12 enter the pocket 120 (not shown), stationary rod 160 biases the ends of the wrapping paper 18 inward toward the center of the workpiece. This condition is shown only on one side of FIG. 12 for clarity. However, it is to be understood that this occurs on both sides of the workpiece 12.

The stuffer spindels 162 make their initial stroke into the workpiece center tubes 13. After they are withdrawn, the star wheels 220 on each side of the workpiece 12 begin to spin on their axles 222 and their arms 224 move in an arcuate direction around approximatley one half of the periphery of the workpiece 12. The rotational motion of each star wheel 220 is produced by gear 530 engaging with gear 520. The arcuate motion of arm 224 is also achieved by gear 530 engaging with gear 520.

As each star wheel 220 spins and as each arm 224 moves along the arcute path, the star wheel ends 226 engage the outer edges of the wrapping paper 18 and fold them against the sides and the toward the center of the workpiece 12. The star wheels 220 stop and the stuffer spindels 162 next re-enter the workpiece center tube 13 thereby tucking the ends of the folded wrapping paper 18 into the workpiece center tube 13. After the stufer spindels 162 retract, the star wheels 220 begin to spin and move again.

While the star wheels 220 still move in an arcuate motion around the remaining periphery of the workpiece 12 edge, the star wheels 220 only rotate on their axles 222 during a predetermined portion of the remaining arcuate movement. The result is a more aesthetically pleasing wrapped workpiece. Nonrotational motion of the star wheels 220 while continuing the arcuate motion of the arms 224 is acheived by removing a predetermied number of teeth from gear 520 at location 524 and by adding a geneva wheel 540 and pawl 510 to the folder mechanism 500. The arms 224 that support the star wheel axles 222 and star wheels 220 are carried through the nonrotational motion portion of the folder mechanism 500 by the engagement of the geneva wheel 540 with the pawl 510. At the end of the genvea wheel stroke, the gear teeth 522 of gear 520 mesh again wit the gear teeth 532 of gear 530 and rotational motion of the star wheel 220 is resumed. Arcuate motion of arm 224 is never stopped.

In the preferred embodiment, geneva wheel 540 has six faces 542. While six faces are preferred, it is to be understood that any multiple of three would be sufficient to produce the required motion. Pawl 510 is not a traditional pawl in that it does not include pivot and does not aply to racheting motion. Instead the pawl 510 functions like a cam follower having a bearing surface 512.

Referring to FIG. 1A, the rotating carousel pocket 150 next rotates to an exit conveyor 300 where a pair of upper and lower conveyor belts 302 and 304, having a fixed gap and moving linearly at the same rate as the rate of rotation of the carousel by means of a four bar linkage 306, grips each wrapped workpiece 12 as it is ejected by an ejector bar 290 within the pocket 150. Upper belt 302 and lower belt 304 pivot on their respective centers 307 and 308 mounted to frame 311 and are driven by one to one crank 309 through link 310. This allows the centers of pulleys 312 and 313 to oscillate in time with the constant speed of each pocket 150 in carousel 100 and allows ejector bar 290 to timely eject fully wrapped workpiece 12 between belts 302 and 304.

Each ejector bar 290 of each pocket 150 is actuated by an ejector bar cam 292. The cam 292 is mounted parallel to the carousel 100 by means of bracketing which is fixed to frame 30. The cam 292 is stationary and does not rotate. The first end of a connecting rod 294 is connected to the ejector bar 290 and is guided by linear bearing 295. The opposite end is connected to a cam follower 296 which rides in cam 292. When a rotating carousel pocket 150 comes into alignment with the exit conveyor 300, the ejector bar 290 and connecting rod 294 are pushed outward by the cam follower 296 which rides in the cam 292. The wrapped workpiece 12 is ejected into exit conveyor 300 between belts 302 and 304.

Figure 30:
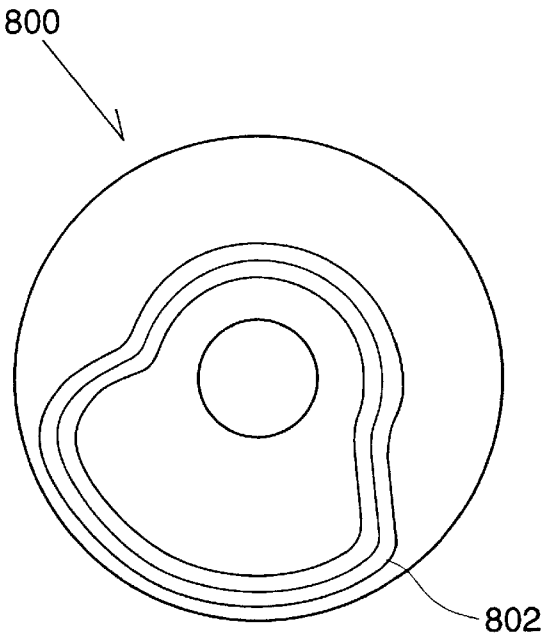
FIG. 30 is a front elevational view of the ejector bar cam.
Figure 29:
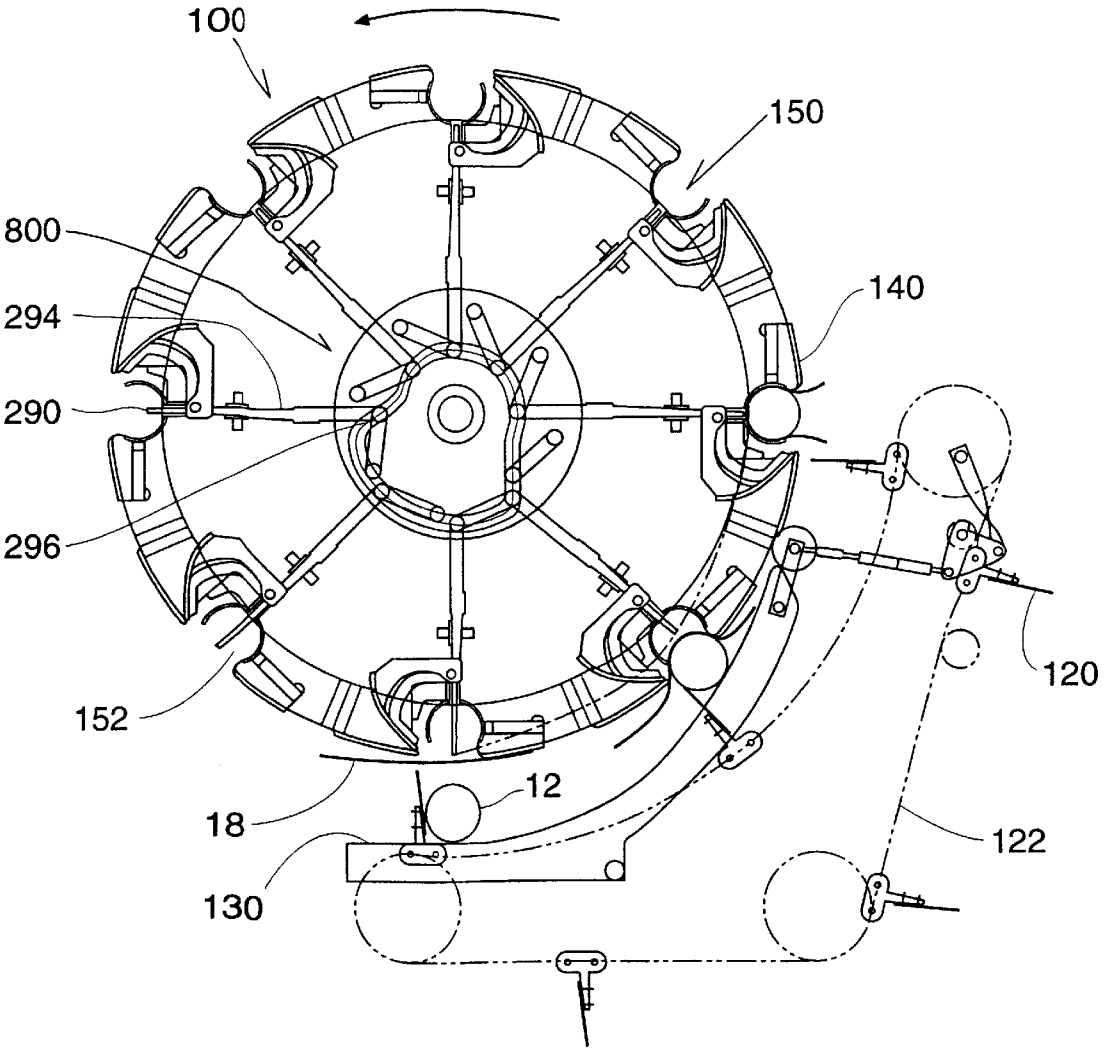
FIG. 29 is a front elevational view of the back side of the rotating carousel.

Referring to FIGS. 29 and 30, an alternative ejector bar cam 800 having cam path 802 is shown. Utilizing cam 800, ejector bar 290 remains in its fully extended state after the workpiece 12 has been ejected onto exit conveyor 300. As the carousel 100 continues to rotate, a new workpiece 12 and sheet of wrapping paper 18 are ramped into pocket 150 through pocket opening 152 by the ramp 130 and flight bar 120. As the workpiece 12 is pushed up the ramp 130 by the flight bar 120, ejector bar 290 comes into contact with the workpiece 12 having the wrapping paper 18 trapped there between. As the workpiece 12 continues its path into the pocket 150, ejector bar 290 applies a slight pressure on the workpiece 12 and the wrapping paper 18. Ejector cam bar path 802 exactly matches the ramp 130 path. The slight pressure applied by the ejector bar 290 to the wrapping paper 18 and workpiece 12 prevents the workpiece 12 from rotating or rolling as it is pushed through pocket opening 152 of pocket 150. The ejector bar 290 also prevents wrapping paper 18 from slipping or becoming misaligned within pocket 150. This results in the leading portion and trailing portion of wrapping paper sheet 18 extending out of the pocket opening 152 at the same length. Accordingly, a consistent lap is produced at the same location as the carousel 100 continues to rotate.

The conveyor belts 302 and 304 carry the wrapped workpiece 12 to a discharge conveyor 310. Once on the discharge conveyor 310, the wrapped workpieces are transported to a location where they are collated, boxed, cartoned, cased, etc.

Figure 7:
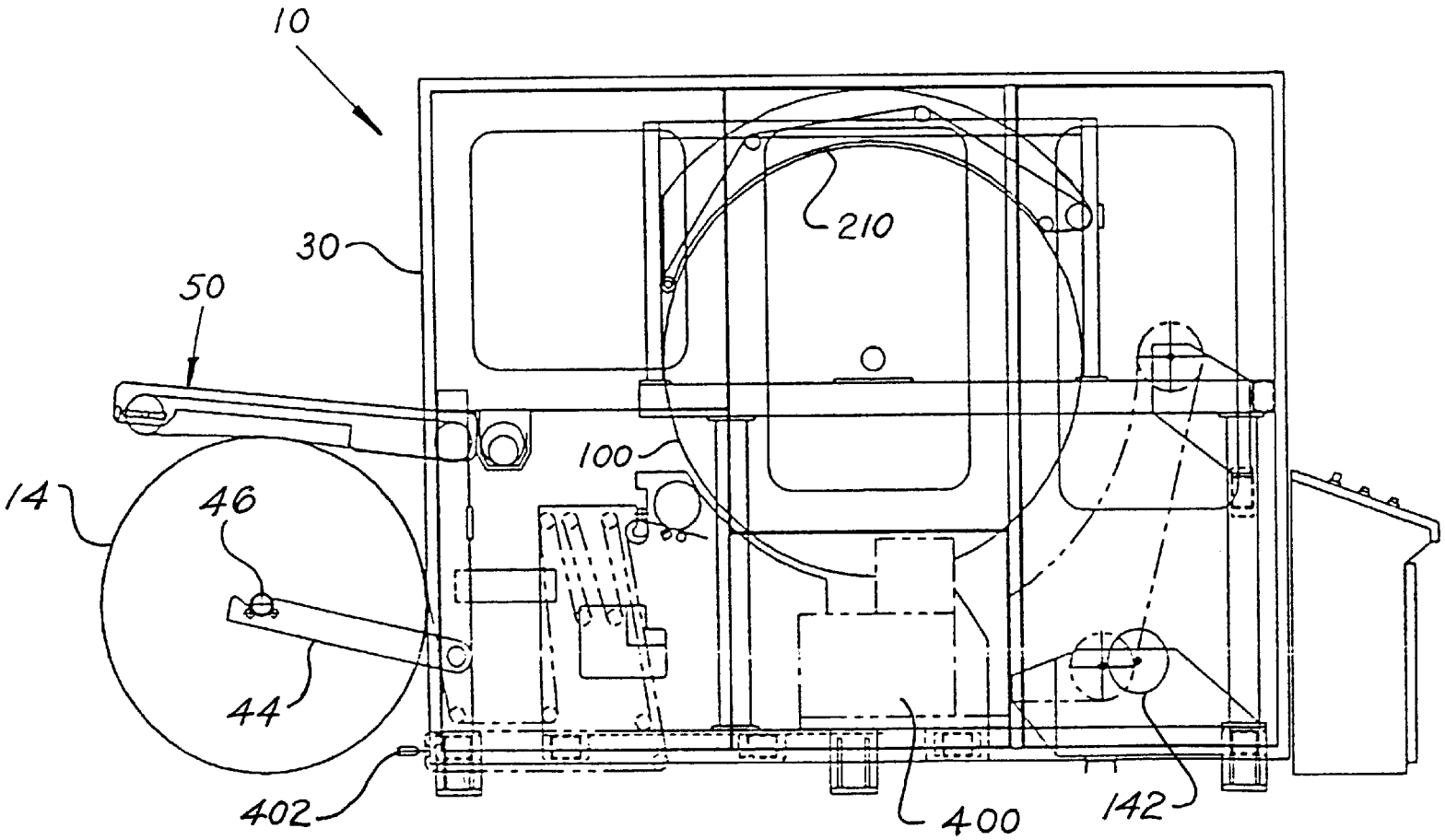
FIG. 7 is rear elevational view of our wrapping machine including an optional gluing mechanism.

As shown in FIG. 7, an optional gluing mechanism 400 can be incorporated into our wrapping machine 10. The gluing mechanism 400 employs glue guns 402 that apply glue to the wrapping paper 15 prior to wrapping the workpieces 12. After application of the glue, the glue is allowed to dry on the wrapping paper 15 prior to the wrapping of the workpiece 12. After the wrapping paper sheet 18 has been banded about the periphery of the workpiece by the pocket 150, underfolder plate 190 and brush 200, heat is applied to belt 210 which remelts the glue and adheres the lapped portions of the wrapping paper to each other. While glue is not required to practice our invention, glue may be desired.

A second alternative folder mechanism, referred to generally as 600, is shown in FIGS. 13–28. The folder mechanism 600 produces the most aesthetically pleasing wrap while allowing the wrapping machine 10 to run at its highest speeds and not tear the wrapping paper 18.

Figure 20:
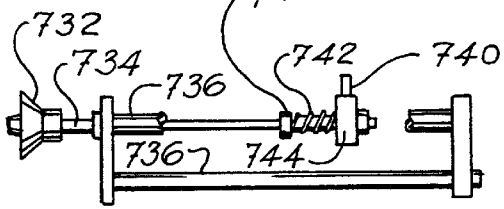
FIG. 20 is a front elevational view of the second alternative stuffer spindle mechanism.
Figure 24:
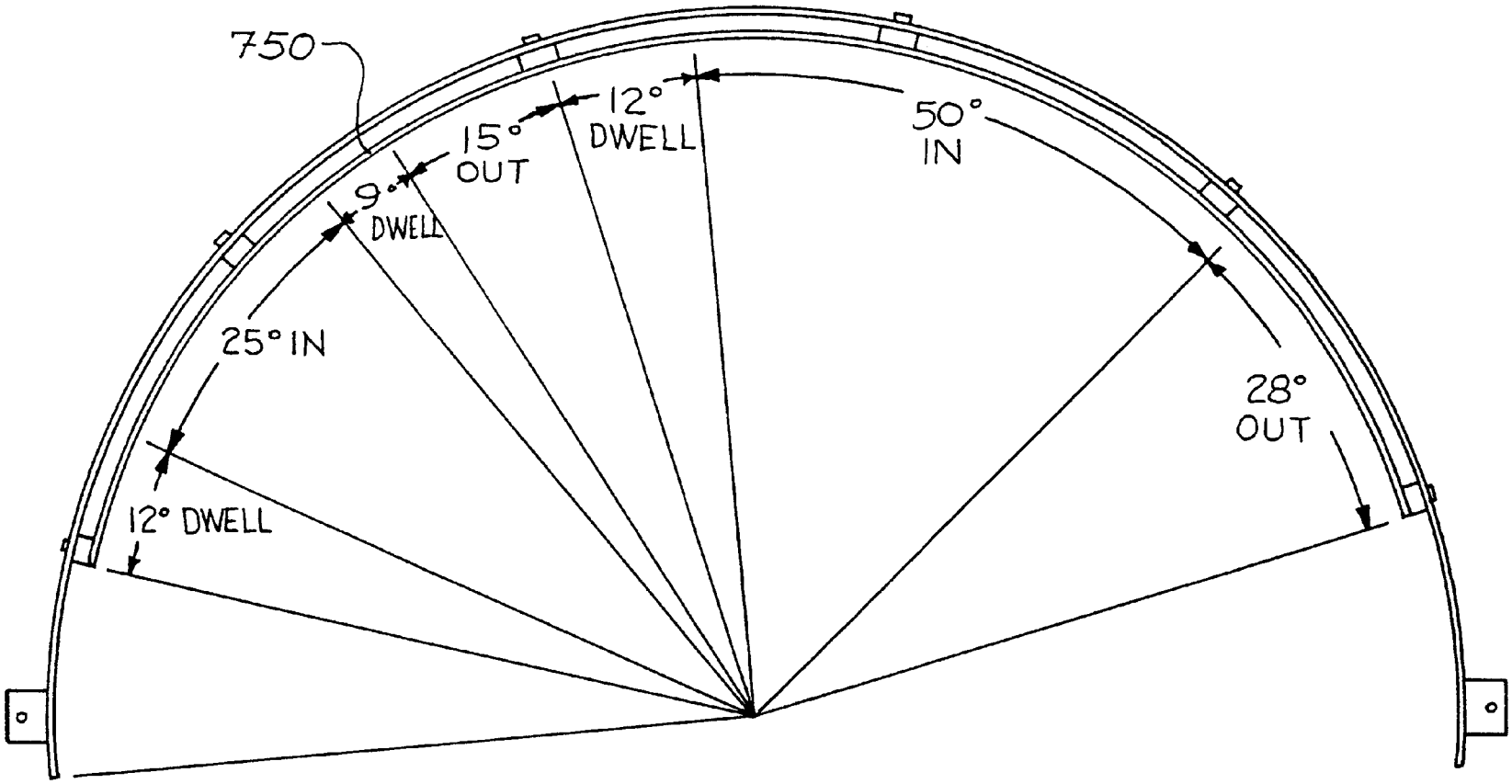
FIG. 24 is a front elevational view of the stuffer spindle barrel cam showing the cam timing.
Figure 28:
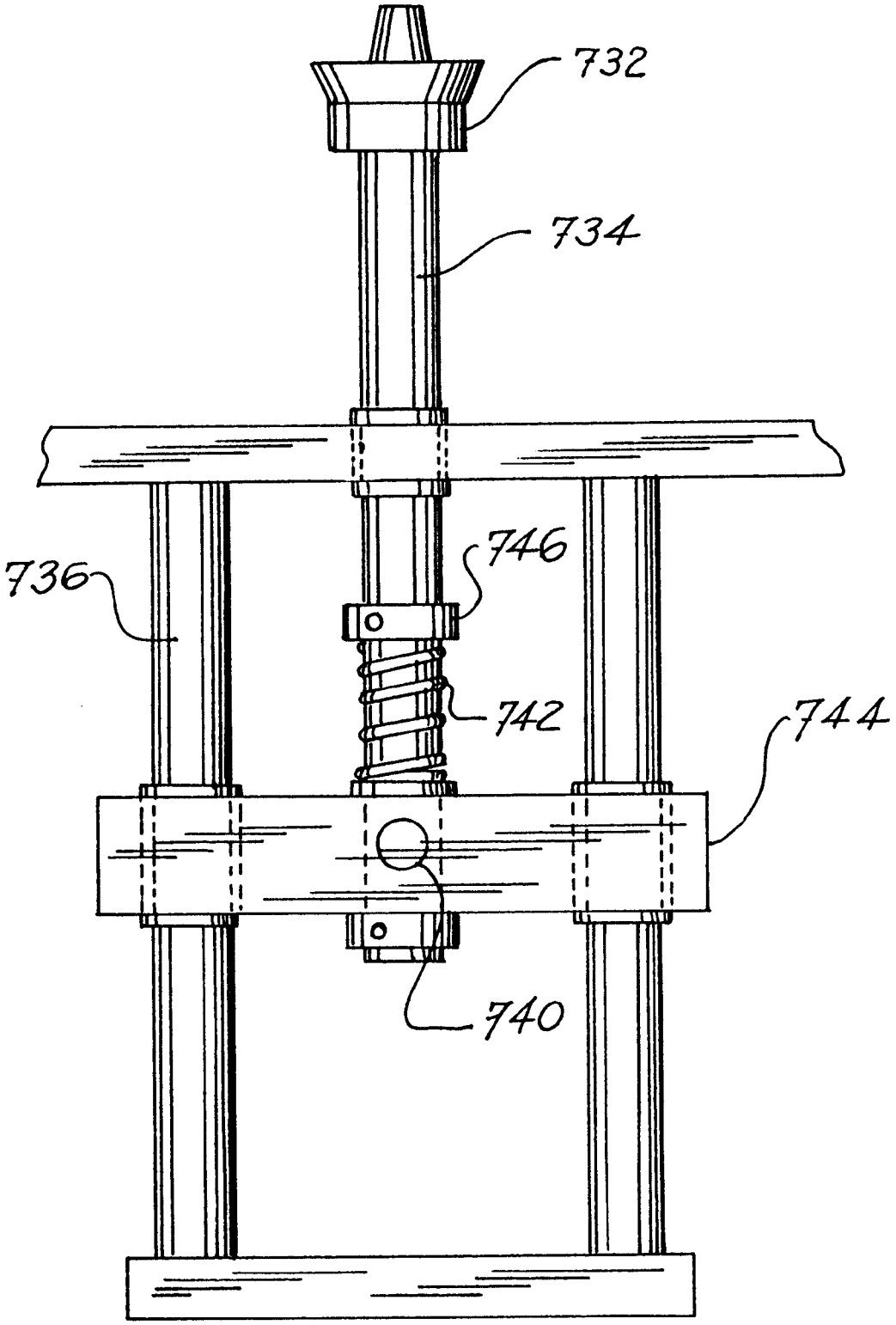
FIG. 28 is a top plan view of the second alternative stuffer spindle mechanism.

Alternative folder mechanism 600 requires its own stuffer mechanism 720 which varies in both function and structure from those previously disclosed. As best shown in FIGS. 20 and 28, each stuffer spindle 732, which helps to form the wrap on the side of the work piece 12 and tucks the wrapping paper 18 into the center core 13, is attached to a rod 734. The stuffer spindles 732 are actuated by stuffer actuating cam followers 740. Each cam follower 740 is driven by a barrel cam 750 having a cam track 752 which controls when the stuffer spindles 732 are advanced toward or inserted into the work piece center tube 13 and when the stuffer spindles 732 are retracted from the work piece center tube 13. The upper portion of the barrel cam 750 is shown laid flat in FIG. 19. FIG. 24 shows the timing of the barrel cam 750 upper portion including its dwell portion, inward portion, second dwell portion, withdraw portion, third dwell portion, insert portion, and its second withdraw portion. The entire camed stuffer mechanism 720 is driven by the rotation of the carousel 100. The barrel cam 750 is attached to the wrapping machine frame 30 and is located parallel and adjacent the carousel 100 as previously disclosed. The diameter of the entire barrel cam 750 is approximately the same as the diameter of the carousel 100.

After the wrapping paper 18 is fully banded around the outer circumference of the work piece 12, the pair of stuffer spindles 732 approach the work piece 12 and stop a predetermined distance from the work piece center tube 13.

Figure 13:
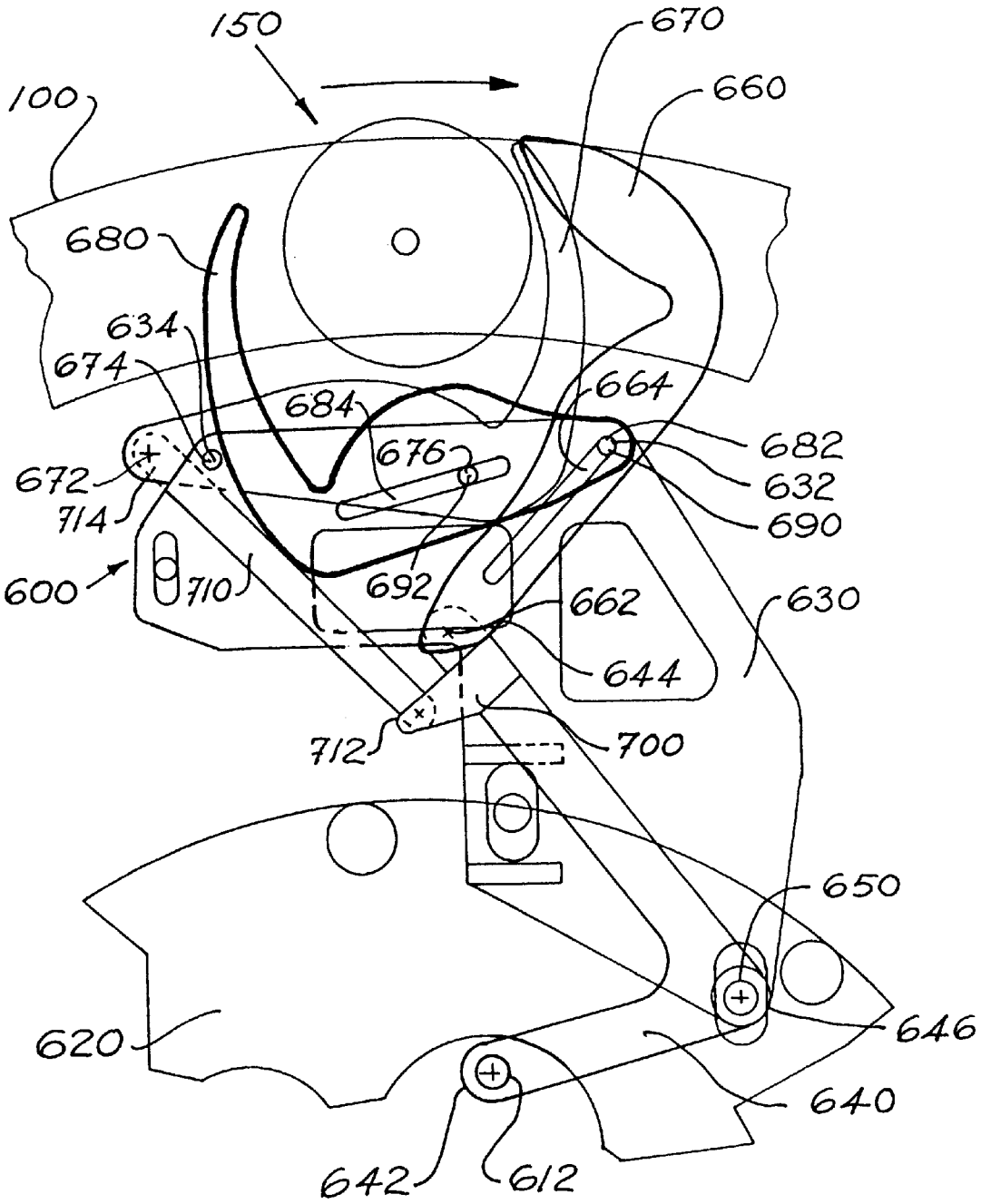
FIG. 13 is a detailed side elevational view of the second alternative folder mechanism with its fingers in the open position.
Figure 14:
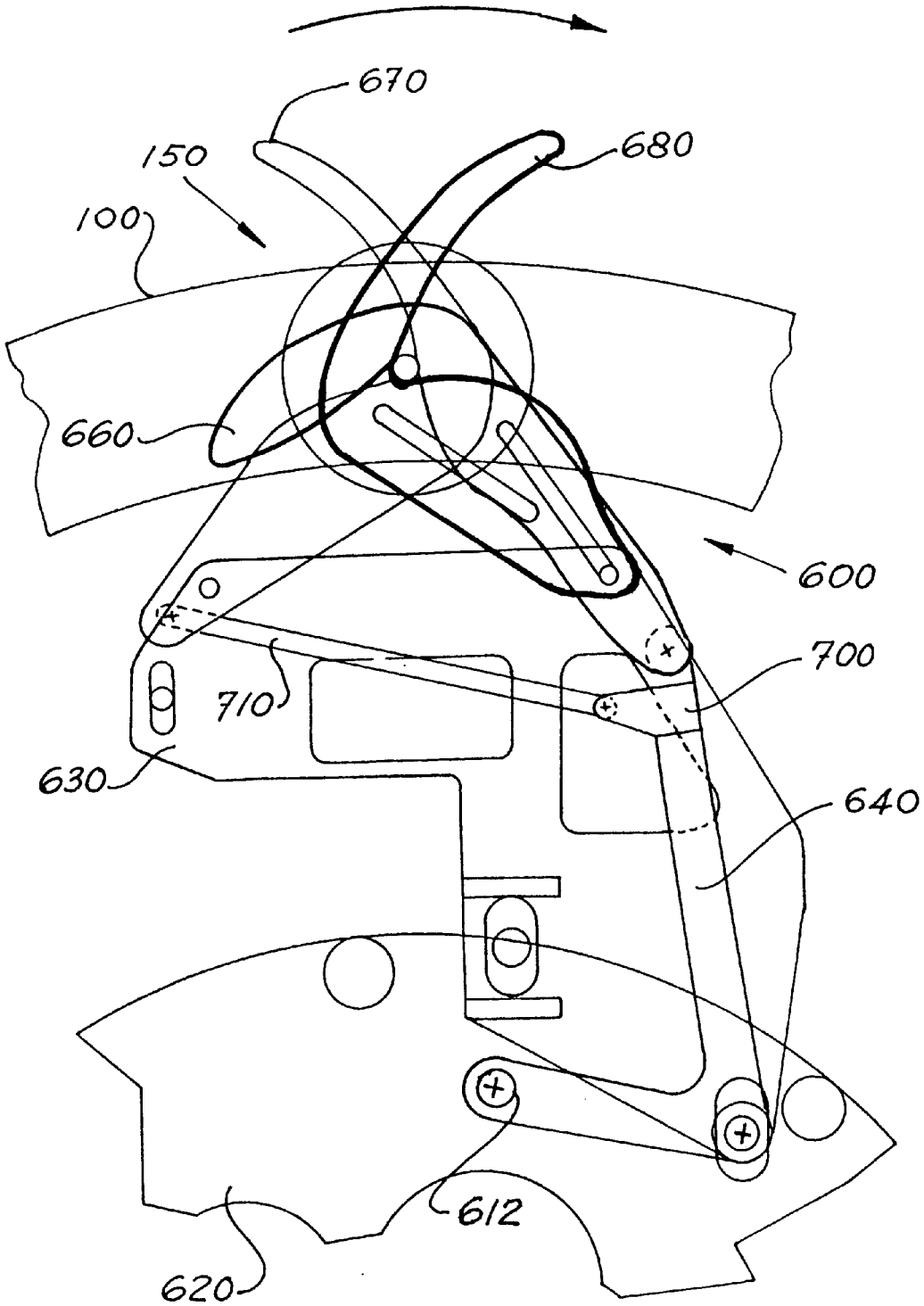
FIG. 14 is a detailed side elevational view of the second alternative folder mechanism with its fingers in the closed position.
Figure 25:
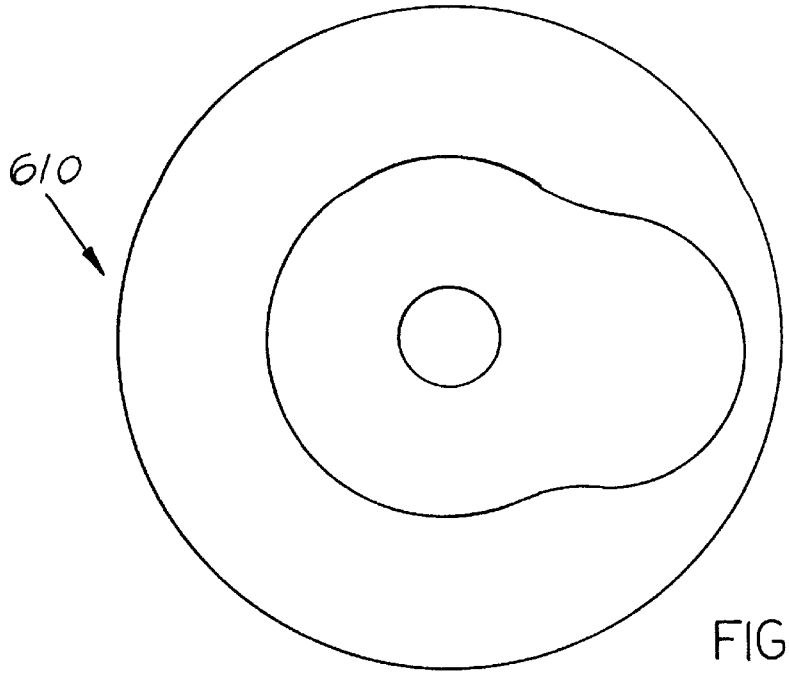
FIG. 25 is a front elevational view of the activating arm or crimping cam.
Figure 27:
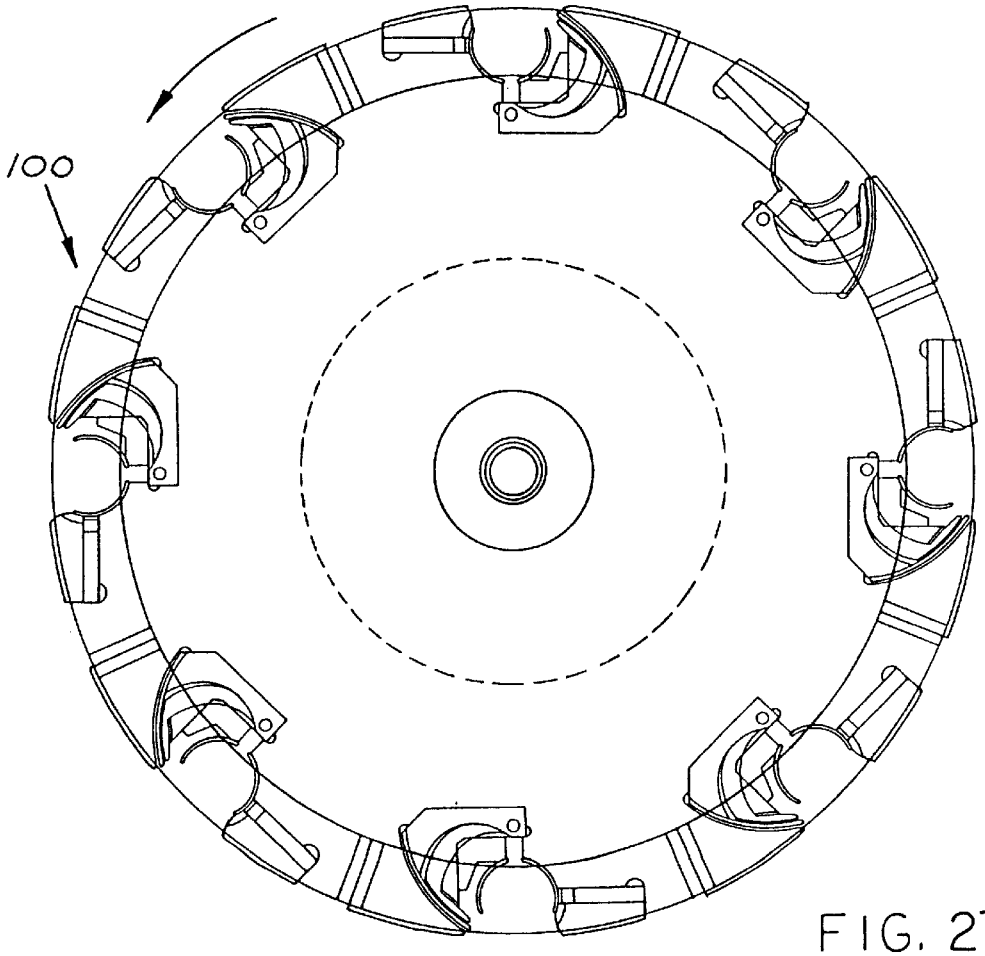
FIG. 27 is a front elevational view of the back side of the rotating carousel.
Figure 26:
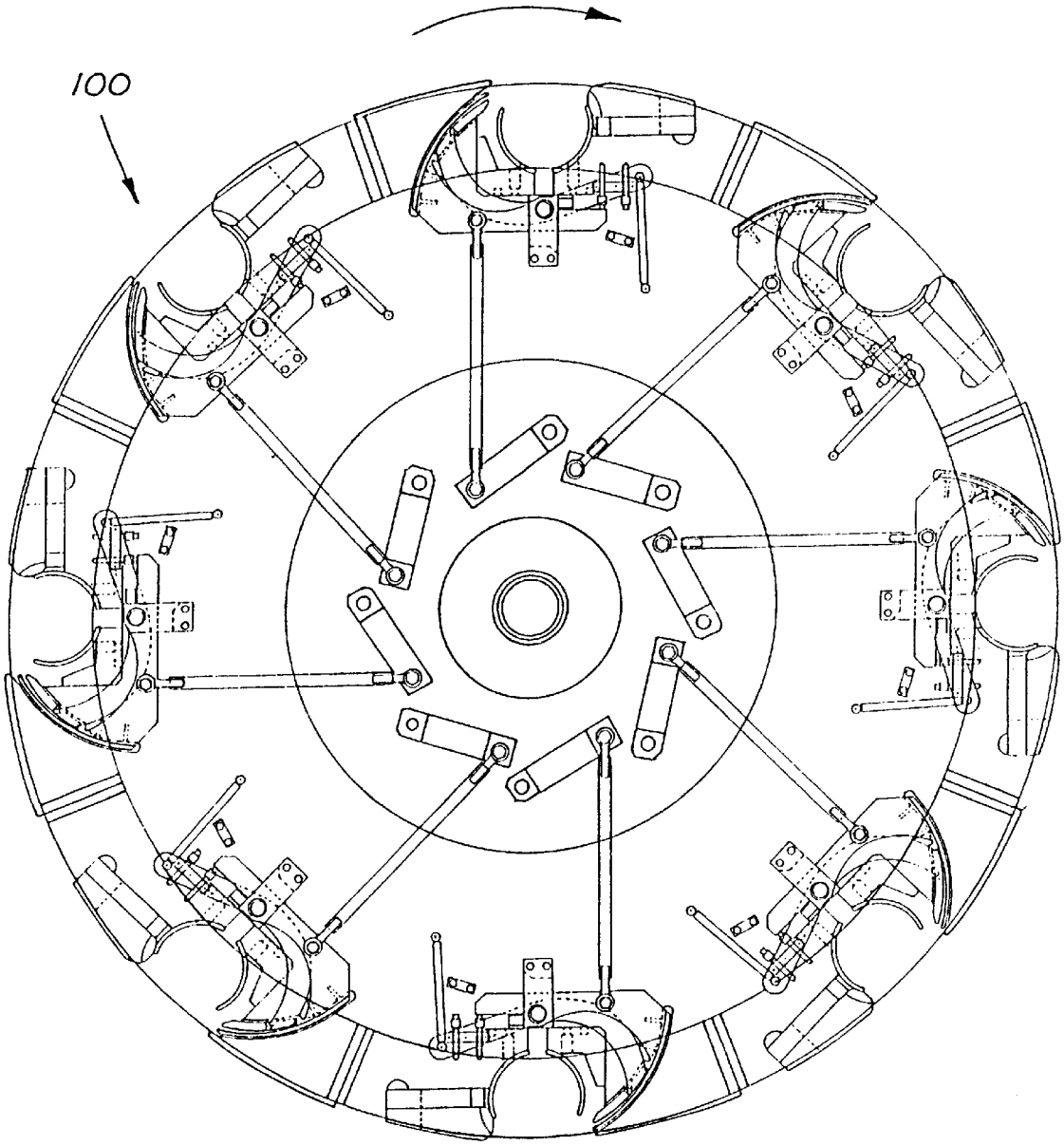
FIG. 26 is a front elevational view of the front side of the rotating carousel.

As best shown in FIGS. 13 and 14, a pair of folder mechanisms 600 are mounted to the rotating carousel 100 adjacent each pocket 150. In other words, a folder mechanism 600 is mounted on each side of rotating carousel 100 at each pocket 150. Each pair of folder mechanism 600 is driven by a crimper cam 610 that is mounted to the wrapping machine frame 30. The cam 610 is shown in FIG. 25. The cam 610 is stationary and does not rotate with the carousel 100. Within the cam 610 are located a plurality of cam followers 612. The number of cam followers 612 is the same as the number of pockets 150 on the rotating carousel 100.

Referring to FIG. 13, a lever plate 620 is mounted on the side of the rotating carousel 100. A crimper frame 630 is attached to each side of the carousel 100. The lever plate 620 is mounted to the carousel 100. Each crimper frame 630 extends from the lever plate 620 toward the corresponding pocket 150 and is rigidly connected to the lever plate 620. A is substantially "L" shaped activating arm 640 includes a first end 642, a second end 644, and an apex 646. Apex 646 is pivotally connected to lever plate 620 by means of a pivot shaft 650. The cam follower 612 is mounted to first end 642. As cam follower 612 moves in cam 610, activating arm 640 pivots at pivot shaft 650 and second end 644 of activating arm 640 moves in an arc around shaft pivot 650.

Figure 15:
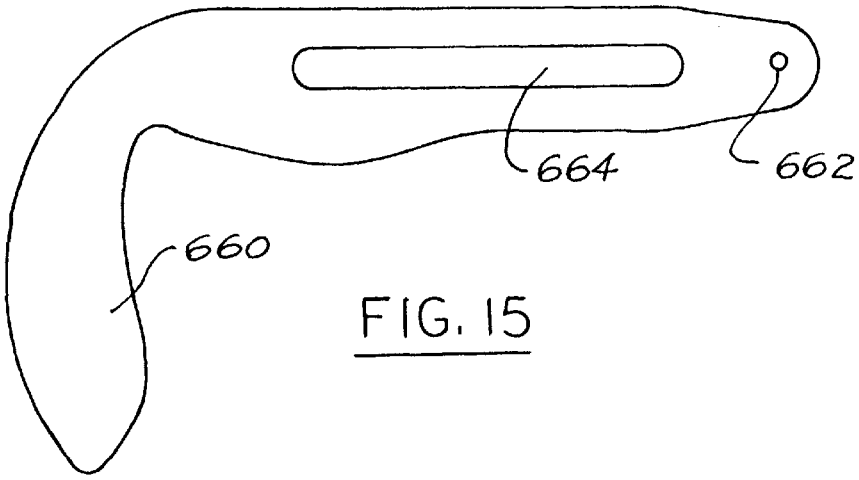
FIG. 15 is a front elevational view of the first finger.
Figure 16:
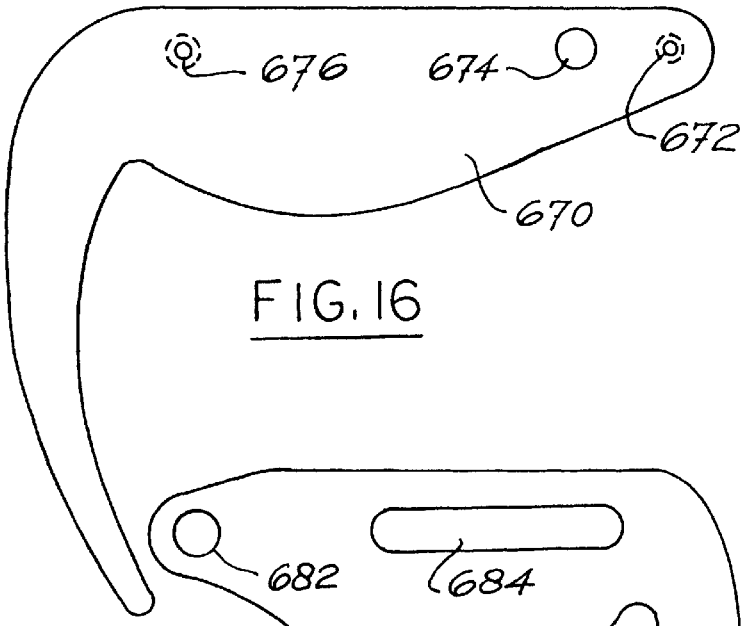
FIG. 16, is a front elevational view of the second finger.
Figure 17:
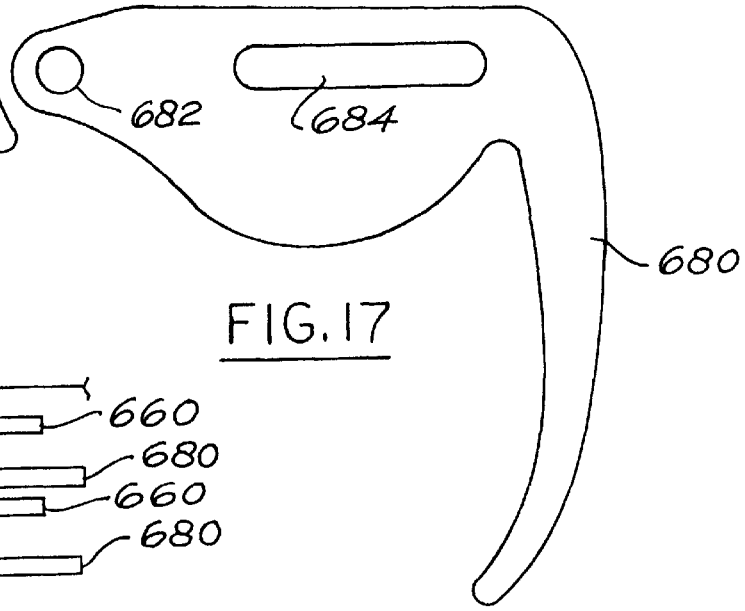
FIG. 17 is a front elevational view of the third finger.
Figure 18:
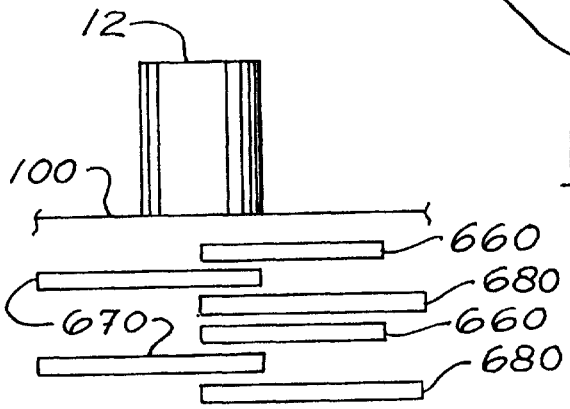
FIG. 18 is a cutaway top plan view showing the configuration of the three pairs of fingers.
Figure 19:
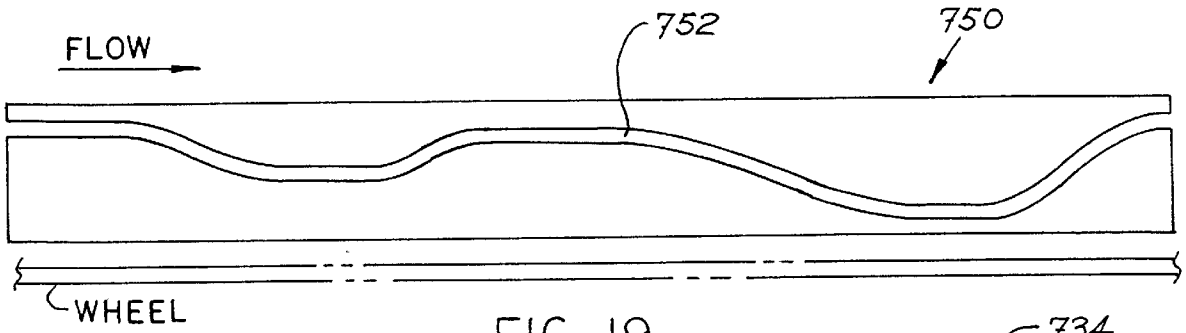
FIG. 19 is a view of the barrel cam of FIG. 24 laid flat.

Again referring to FIG. 13, the folder mechanism 600 of the preferred embodiment further includes three pairs of folding or crimping fingers 660, 670, and 680. For purposes of clarity in FIGS. 13 and 14, each finger is shown in a different line thickness. The geometry of each finger is shown in FIGS. 15 through 17. As shown in FIG. 15, finger 660 includes an aperture 662 and a slot 664. As shown in FIG. 16, finger 670 includes apertures 672, 674, and 676. As shown in FIG. 17, finger 680 includes apertures 682 and slot 684. Referring to FIG. 18, the arrangement of the three pairs 660,670, and 680 with respect to rotating carousel 100 and a typical work piece 12 can be seen.

Referring back to FIG. 13, finger 660 is pivotally connected to second end 644 of activating arm 640 at aperture 662. A first slide block and pivot pin 690 is fixedly connected to crimper plate 630 at 632. The slide block 690 is received within finger slot 664.

Near second end 644 of activating arm 640, an offset arm 700 is attached. A connecting link 710 has its first end 712 connected to the end of offset arm 700 that projects away from second end 644 of activating arm 640. The opposite end 714 of connecting link 710 is pivotally attached to aperture 672 of finger 670. Aperture 674 of finger 670 is pivotally connected to crimper frame 630 at 634. A second slide block and pivot pin 692 is connected to aperture 676 of finger 670. Finger 680 is incorporated into the folder mechanism 600 by its aperture 682 being pivotally connected to pivot pin 690 and its elongated slot 684 receiving slide block 692.

Thus, fingers 660, 670, and 680 work in unison as follows. As cam follower 612 rides in cam 610, activating arm 640 pivots about pivot shaft 650. When pivoted, second end 644 of activating arm 640 moves in an arc about pivot point 650. This movement in turn causes finger 660 to move in an arc toward pocket 150 around pivot point 690. Simultaneously, finger 670 is pivoted around aperture 674 toward pocket 150 at point 634 by means of connecting link 710. Still simultaneously, finger 680 moves in an arc about pin 632 also toward pocket 150. FIG. 14 shows the fingers 660, 670, and 680 in the fully closed position.

When the stuffer spindles 732 have moved to the predetermined distance from the work piece 12, the three pairs of fingers, 660, 670, and 680 on each side of the work piece 12 begin to close; i.e. move from the position shown in FIG. 13 to the position shown in FIG. 14. The stuffer spindle 732 initially acts as a mandrel to prevent the ends of the wrapping paper 18 from collapsing toward the work piece 12 end. As the three pairs of fingers 660, 670, and 680 continue to close on each side of the work piece 12, each stuffer spindle 732 is withdrawn. If each stuffer spindle 732 was not withdrawn, the fingers 660, 670, and 680 would close into the spindle 732.

Figure 22:
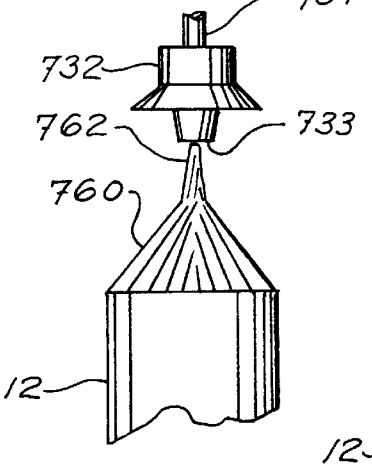
FIG. 22 is a front elevational view of the stuffer spindle and a partially wrapped work piece.

After the three pairs of fingers 660, 670, and 680 have reached their fully closed position as shown in FIG. 14, the fingers 660, 670, and 680 open and return to their position as shown in FIG. 13. The three pairs of fingers 660, 670, and 680 form a column-like structure 760 of wrapping paper as shown in FIG. 22. The column terminates at end 762.

Figure 23:
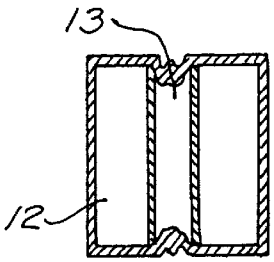
FIG. 23 is a cutaway view of a wrapped work piece.
Figure 21:
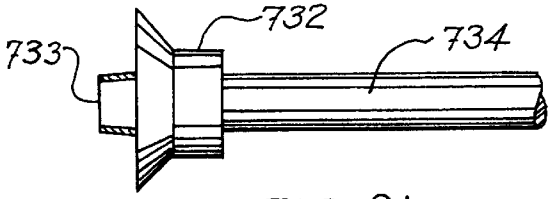
FIG. 21 is a detailed front elevational view of the stuffer spindle.

As the fingers reopen, stuffer spindles 732 reapproach the ends of work piece 12. Each stuffer spindle 732 includes an opening 733 in its end as shown in FIGS. 21 and 22. The tip 762 of the column-like wrapping paper end structure enters the opening 733 as the spindle 732 continues to approach the work piece 12. The stuffer spindle 732 compresses the wrapping paper 18 against the side of the work piece 12 and tucks the top end portion 762 into the center tube 13 as shown in FIG. 23. The stuffer spindle causes the wrapping paper 18 to fill the diameter of the center tube 13.

Referring to FIGS. 20 and 28, the force of the stuffer spindles 732 which enters center tube 13 of work piece 12 is limited by a spring 742 which is mounted about each spindle rod 734. The cam follower 740 which rides in barrel cam 750 is mounted to a bearing block 744. The bearing block 744 rides on parallel rods 736. As shown in FIGS. 20 and 28, the spring 742 is positioned between bearing block 744 and collar 746 which is fixed to rod 734. When the barrel cam 750 and cam follower 740 system push the stuffer spindle 732 and a portion of the wrapping paper into the center of the tube 13 of work piece 12, resistance may be encountered as the stuffer spindle 732 pushes the gathered or conical portion 762 of wrapping paper 18 into center tube 13. When this occurs, spring 742 compresses between bearing block 744 and collar 746. Thus, the stuffing pressure of the stuffer spindles 732 is limited to the compression rate of the spring 742.

What is claimed is:

1. An apparatus for wrapping work pieces with a wrapper, the apparatus comprising:

a frame structure;

a rotating carousel mechanism having a plurality of wrapping stations, the carousel mechanism coupled to the frame structure;

each wrapping station having a clamping mechanism, an underfolding mechanism, a plurality of stuffer mechanisms, and a plurality of folder mechanisms;

the clamping mechanism pivotally mounted to the carousel mechanism adjacent each wrapping station and arranged to firmly clamp one of said workpieces in each wrapping station;

the underfolding mechanism pivotally mounted to the carousel mechanism adjacent each wrapping station and arranged to fold an end of said wrapper around said clamped workpiece;

the stuffer mechanisms retractably mounted to the carousel mechanism adjacent each wrapping station; and the folder mechanism mounted to the carousel mechanism adjacent each wrapping station.

2. An apparatus for wrapping work pieces, the apparatus comprising:

a frame structure;

a rotating carousel mechanism having a plurality of wrapping stations, the carousel mechanism coupled to the frame structure;

each wrapping station having a clamping mechanism, an underfolding mechanism, a plurality of stuffer mechanisms, and a plurality of folder mechanisms;

the clamping mechanism pivotally mounted to the carousel mechanism adjacent each wrapping station;

the underfolding mechanism pivotally mounted to the carousel mechanism adjacent each wrapping station;

the stuffer mechanisms retractable mounted to the carousel mechanism adjacent each wrapping station;

the folder mechanism mounted to the carousel mechanism adjacent each wrapping station and including a lever plate, said lever plate attached to said frame structure;

a crimper frame, said crimper frame coupled to said lever plate;

an arm structure, said arm structure pivotally coupled to said crimper frame and said lever plate;

a connecting link having a first end and a second end;

said first end of said connecting ink coupled to said arm structure;

a finger mechanism, said finger mechanism coupled to said crimper frame;

said second end of said connecting link coupled to said finger mechanism.

3. The apparatus of claim 2 wherein said arm structure comprises:

an activating arm having a first end, a second end, and an apex;

said apex of said activating arm coupled to said lever plate;

said second end of said activating arm coupled to said finger mechanism;

an offset arm having a first end and a second end;

said first end of said offset arm coupled to said activating arm;

said second end of said offset arm coupled to said first end of said connecting link;

said first end of said activating arm having a cam follower;

said cam follower engaged within a cam.

4. The apparatus of claim 3, wherein said apex of said activating arm is coupled to said crimper frame and said lever plate by means of a pivot shaft.

5. The apparatus of claim 2, wherein said finger mechanism comprises:

a first pair of fingers having a first end, a second end, a first slide block, and a longitudinal opening formed therein;

said first end of said first pair of fingers pivotally connected to said second end of said activating arm;

a second pair of fingers having a first end, a second end, a midsection, and an aperture formed therein;

said first end of said second pair of fingers coupled to said second end of said connecting link;

said midsection of said second pair of fingers pivotally connected to said crimper frame;

a third pair of fingers having a first end, a second end, a second slide block, an aperture formed therein, and a longitudinal opening formed therein;

said first slide block of said first pair of fingers rides within said longitudinal opening of said first pair of fingers and within said aperture of said third pair of fingers;

said second slide block rides within said longitudinal opening of said third pair of fingers and within said aperture of said second pair of fingers.

6. The apparatus of claim 1, wherein said stuffer mechanism comprises:

a barrel cam, said barrel cam mounted to the frame structure;

a cam follower structure, said cam follower structure located within said barrel cam;

a stuffer spindle having an opening formed therein;

a stuffer rod having a first end and a second end;

said first end of said stuffer rod coupled to said stuffer spindle;

said second end of said stuffer rod coupled to said cam follower structure.

7. An apparatus for wrapping work pieces, the apparatus comprising:

a frame structure;

a rotating carousel mechanism having a plurality of wrapping stations, the carousel mechanism coupled to the frame structure;

each wrapping station having a clamping mechanism, an underfolding mechanism, a plurality of stuffer mechanisms, and a plurality of folder mechanisms;

the clamping mechanism pivotally mounted to the carousel mechanism adjacent each wrapping station;

the underfolding mechanism pivotally mounted to the carousel mechanism adjacent each wrapping station;

the stuffer mechanisms retractable mounted to the carousel mechanism adjacent each wrapping station and including a barrel cam, said barrel cam mounted to the frame structure;

a cam follower structure, said cam follower structure located within said barrel cam;

a stuffer spindle having an opening formed therein;

a stuffer rod having a first end and a second end;

said first end of said stuffer rod coupled to said stuffer spindle;

said second end of said stuffer rod coupled to said cam follower structure;

a spring having a first end and a second end;

said stuffer rod having a collar;

said first end of said spring coupled to said collar of said stuffer rod;

said second end of said spring coupled to said cam follower structure; and the folder mechanism mounted to the carousel mechanism adjacent each wrapping station.

8. The apparatus of claim 6, wherein said cam follower structure comprises a bearing block having a cam follower engaged within said barrel cam, said bearing block coupled to said second end of said stuffer rod.

9. The apparatus of claim 1, wherein each of said work pieces includes:

a center tube;

said wrapper having two ends extending outwardly a predetermined distance beyond said work piece;

said folder mechanism engaging said ends of said wrapper forming a paper column structure; and said paper column structure entering said opening formed within said stuffer spindle, said stuffer spindle compressing said paper column structure into said center tube of said work pieces.

10. The apparatus of claim 1 wherein the clamping mechanism comprises:

a clamp plate;

a clamp arm having a first end, a second end, and a pivot point;

the first end connected to the clamp plate and the pivot point pivotally connected to the carousel mechanism;

a spring having two ends, the first spring end connected to the second clamp arm end and the second spring end connected to the carousel mechanism;

an adjustable ear attached to the clamp arm between the pivot point and the second end; and a camming mechanism for pivoting the clamp plate, the camming mechanism contacting the ear.

11. The apparatus of claim 1 wherein the underfolding mechanism comprises:

an underfolder plate;

an underfolder arm having a first end, a second end, a pivot point, and an actuating point;

the first end connected to the underfolder plate and the pivot point pivotally connected to the carousel mechanism;

a camming mechanism for pivoting the underfolder plate, the camming mechanism connected to the arm at the actuating point.

12. The apparatus of claim 1 further including:

an ejector bar mounted within each wrapping station;

a cam mounted to the frame structure;

a cam follower riding in the cam;

a connecting rod having a first and second end, the first end connected to the cam follower and the second end connected to the ejector bar.

13. The apparatus of claim 1 further including:

an infeed conveyor connected to the frame structure.

14. The apparatus of claim 1 further comprising:

an ejector bar cam mounted to the frame structure;

a cam follower riding in the cam;

an ejector bar having two ends, the first end being coupled to said cam follower and the second end being retractably mounted within one of said wrapping stations.

15. The apparatus of claim 14 whereby the ejector bar second end applies a predetermined pressure on said workpiece during a predetermined time period.

16. An apparatus for wrapping work pieces having opposed sides with a wrapper, the apparatus comprising:

a frame structure;

a rotating carousel mechanism having a plurality of wrapping stations, the carousel mechanism rotatably coupled to the frame structure;

each wrapping station having a clamping mechanism, an underfolding mechanism, a plurality of stuffer mechanisms, and a plurality of folder mechanisms;

the clamping mechanism pivotally mounted to the carousel mechanism adjacent each wrapping station and arranged to firmly clamp one of said workpieces in each wrapping station;

the underfolding mechanism pivotally mounted to the carousel mechanism adjacent each wrapping station and arranged to fold an end of said wrapper around said clamped workpiece;

the folder mechanism mounted to the carousel mechanism adjacent each wrapping station and arranged to fold the wrapper along each workpiece side; and the stuffer mechanisms retractably mounted to the carousel mechanism adjacent each wrapping station and arranged to stuff said wrapper into each said workpiece.

17. The apparatus of claim 16, wherein said folder mechanism comprises:

a lever plate, said lever plate attached to said frame structure;

a crimper frame, said crimper frame coupled to said lever plate;

an arm structure, said arm structure pivotally coupled to said crimper frame and said lever plate;

a connecting link having a first end and a second end;

said first end of said connecting link coupled to said arm structure;

a finger mechanism, said finger mechanism coupled to said crimper frame; and said second end of said connecting ink coupled to said finger mechanism.

18. The apparatus of claim 17 wherein said arm structure comprises:

an activating arm having a first end, a second end, and an apex;

said apex of said activating arm coupled to said lever plate;

said second end of said activating arm coupled to said finger mechanism;

an offset arm having a first end and a second end;

said first end of said offset arm coupled to said activating arm;

said second end of said offset arm coupled to said first end of said connecting link;

said first end of said activating arm having a cam follower; and said cam follower engaged within a cam.

19. The apparatus of claim 18, wherein said finger mechanism comprises:

a first pair of fingers having a first end, a second end, a first slide block, and a longitudinal opening formed therein;

said first end of said first pair of fingers pivotally connected to said second end of said activating arm;

a second pair of fingers having a first end, a second end, a midsection, and an aperture formed therein;

said first end of said second pair of fingers coupled to said second end of said connecting link;

said midsection of said second pair of fingers pivotally connected to said crimper frame;

a third pair of fingers having a first end, a second end, a second slide block, an aperture formed therein, and a longitudinal opening formed therein;

said first slide block of said first pair of fingers rides within said longitudinal opening of said first pair of fingers and within said aperture of said third pair of fingers; and said second slide block rides within said longitudinal opening of said third pair of fingers and within said aperture of said second pair of fingers.

20. The apparatus of claim 16, wherein said stuffer mechanism comprises:

a barrel cam, said barrel cam mounted to the frame structure;

a cam follower structure, said cam follower structure located within said barrel cam;

a stuffer spindle having an opening formed therein;

a stuffer rod having a first end and a second end;

said first end of said stuffer rod coupled to said stuffer spindle; and said second end of said stuffer rod coupled to said cam follower structure.

21. The apparatus of claim 20, wherein each of said work pieces includes:

a center tube;

said wrapper having two ends extending outwardly a predetermined distance beyond said work piece sides;

said folder mechanism engaging said ends of said wrapper forming a paper column structure; and said paper column structure entering said opening formed within said stuffer spindle and said stuffer spindle compressing said paper column structure into said center tube of said work pieces.

22. The apparatus of claim 16 wherein the clamping mechanism comprises:

a clamp plate;

a clamp arm having a first end, a second end, and a pivot point;

the first end connected to the clamp plate and the pivot point pivotally connected to the carousel mechanism;

a spring having two ends, the first spring end connected to the second clamp arm end and the second spring end connected to the carousel mechanism;

an adjustable ear attached to the clamp arm between the pivot point and the second end; and a camming mechanism for pivoting the clamp plate, the camming mechanism contacting the ear.

23. The apparatus of claim 16 wherein the underfolding mechanism comprises:

an underfolder plate;

an underfolder arm having a first end, a second end, a pivot point, and an actuating point;

the first end connected to the underfolder plate and the pivot point pivotally connected to the carousel mechanism; and a camming mechanism for pivoting the underfolder plate, the camming mechanism connected to the arm at the actuating point.

24. The apparatus of claim 16 further including:

an ejector bar mounted within each wrapping station;

a cam mounted to the frame;

a cam follower riding in the cam; and a connecting rod having a first and second end, the first end connected to the cam follower and the second end connected to the ejector bar.

25. The apparatus of claim 16 further including:

an infeed conveyor connected to the frame structure.

26. The apparatus of claim 16 further comprising:

an ejector bar cam mounted to the frame structure;

a cam follower riding in the cam; and an ejector bar having two ends, the first end being coupled to said cam follower and the second end being retractably mounted within one of said wrapping stations.

27. An apparatus for wrapping workpieces with a wrapper, the apparatus comprising:

a frame structure;

a rotating carousel mechanism having a plurality of wrapping stations, the carousel mechanism coupled to the frame structure;

a brush mechanism, the brush mechanism coupled to the frame structure;

each wrapping station having a clamping mechanism, an underfolding mechanism, a plurality of stuffer mechanisms, and a plurality of folder mechanisms;

the clamping mechanism pivotally mounted to the carousel mechanism adjacent each wrapping station and arranged to firmly clamp one of said workpieces in each wrapping station;

the underfolding mechanism pivotally mounted to the carousel mechanism adjacent each wrapping station and arranged to fold an end of said wrapper around said clamped workpiece;

the stuffer mechanisms retractably mounted to the carousel mechanism adjacent each wrapping station; and the folder mechanisms rotatably and pivotally mounted to the carousel mechanism adjacent each wrapping station.

28. An apparatus for wrapping workpieces with a wrapper, the apparatus comprising:

a frame structure;

a rotating carousel mechanism having a plurality of wrapping stations, the carousel mechanism coupled to the frame structure;

a drivable belt, the belt being disposed over the frame structure and aligned with the carousel;

each wrapping station having a clamping mechanism, an underfolding mechanism, a plurality of stuffer mechanisms, and a plurality of folder mechanisms;

the clamping mechanism pivotally mounted to the carousel mechanism adjacent each wrapping station and arranged to firmly clamp one of said workpieces in each wrapping station;

the underfolding mechanism pivotally mounted to the carousel mechanism adjacent each wrapping station and arranged to fold an end of said wrapper around said clamped workpiece;

the stuffer mechanisms retractably mounted to the carousel mechanism adjacent each wrapping station; and the folder mechanisms rotatably and pivotally mounted to the carousel mechanism adjacent each wrapping station.

* * * * *

UNITED STATES PATENT AND TRADEMARK OFFICE

CERTIFICATE OF CORRECTION

PATENT NO. : 5,987,847

DATED : 23 November 1999

INVENTOR(S) : John E. Nordstrom and Christopher J. Rusch

It is certified that error appears in the above-identified patent and that said Letters Patent is hereby corrected as shown below:

At [73] on the title page,
delete all reference to the Assignee "Omega Manufacturing Corporation" and substitute therefore - - John E. Nordstrom and Barbara A. Nordstrom - -.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*